US011154876B2

(12) United States Patent
Gopalan et al.

(10) Patent No.: US 11,154,876 B2
(45) Date of Patent: Oct. 26, 2021

(54) MULTI-INLET, MULTI-SPRAY FLUIDIC CUP NOZZLE WITH SHARED INTERACTION REGION AND SPRAY GENERATION METHOD

(71) Applicant: dlhBowles, Inc., Canton, OH (US)

(72) Inventors: Shridhar Gopalan, Westminster, MD (US); Evan Hartranft, Baltimore, MD (US); Russell Hester, Odenton, MD (US)

(73) Assignee: dlhBowles, Inc., Canton, OH (US)

( * ) Notice: Subject to any disclaimer, the term of this patent is extended or adjusted under 35 U.S.C. 154(b) by 505 days.

(21) Appl. No.: 15/433,845

(22) Filed: Feb. 15, 2017

(65) Prior Publication Data

US 2017/0216852 A1 Aug. 3, 2017

Related U.S. Application Data

(63) Continuation of application No. PCT/US2015/045316, filed on Aug. 14, 2015.

(60) Provisional application No. 62/037,913, filed on Aug. 15, 2014.

(51) Int. Cl.
*B05B 1/08* (2006.01)

(52) U.S. Cl.
CPC ..... *B05B 1/08* (2013.01)

(58) Field of Classification Search
CPC ..... B05B 1/08; B05B 1/14; B05B 11/3057; B65D 83/28
USPC ..... 239/589.1
See application file for complete search history.

(56) References Cited

U.S. PATENT DOCUMENTS 4,398,827 A * 8/1983 Dietrich ..... B01F 5/0057 239/404
4,955,547 A 9/1990 Woods
5,542,581 A 8/1996 Habora et al.
5,868,321 A * 2/1999 Haruch ..... B05B 1/3436 239/399

(Continued)

FOREIGN PATENT DOCUMENTS

EP 0663240 7/1995
JP S62-005846 1/1987

(Continued)

OTHER PUBLICATIONS

International Search Report in corresponding International Patent Application No. PCT/US15/45316, dated Dec. 4, 2015.

*Primary Examiner* — Steven M Cernoch
(74) *Attorney, Agent, or Firm* — McDonald Hopkins LLC

(57) ABSTRACT

A conformal, cup-shaped fluidic oscillator spray nozzle member (100, 200, 300, 400, 500) is configured to generate one or more oscillating sprays from fluid flowing into a substantially open proximal end and distally into a substantially closed distal end wall with one or more centrally located orifices defined therein. A multi-input, multi-output cup-shaped fluidic oscillator (200, 300, 400) is configured to generate a selected fluid spray from a plurality of (e.g., 2-8) fluid product inlets which are configured in interacting pairs and feed into a common interaction region of the fluidic nozzle geometry. Optionally, an outlet "A" can be positioned in the interaction region and allow for air entrainment into the interaction region or external oscillating spray streams to generate a foamed spray of fluid product.

25 Claims, 14 Drawing Sheets

(56) References Cited

U.S. PATENT DOCUMENTS

| | | | | |
|---|---|---|---|---|
| 5,992,765 | A * | 11/1999 | Smith | B05B 1/3436 239/337 |
| 6,119,766 | A | 9/2000 | Blomgren | |
| 6,199,766 | B1 * | 3/2001 | Fox | B05B 1/3436 239/3 |
| 6,371,389 | B1 | 4/2002 | Bickart | |
| 6,834,848 | B2 | 12/2004 | Porter et al. | |
| 7,320,417 | B2 | 1/2008 | Eberhardt | |
| 7,341,208 | B2 | 3/2008 | Peters | |
| 7,354,008 | B2 | 4/2008 | Hester et al. | |
| 9,089,856 | B2 | 7/2015 | Gopalan | |
| 9,527,092 | B2 | 12/2016 | Miyamoto | |
| 2001/0011687 | A1 | 8/2001 | Benoist | |
| 2007/0044793 | A1 | 3/2007 | Kleinstreuer et al. | |
| 2008/0315016 | A1 | 12/2008 | Octeau | |

FOREIGN PATENT DOCUMENTS

| | | |
|---|---|---|
| JP | H08-104382 | 4/1996 |
| JP | 2004-314016 | 11/2004 |
| JP | 2011-147920 | 8/2011 |
| WO | WO02/070141 | 9/2002 |

* cited by examiner

MULTI-INLET, MULTI-SPRAY FLUIDIC CUP NOZZLE WITH SHARED INTERACTION REGION AND SPRAY GENERATION METHOD

CROSS REFERENCE TO RELATED APPLICATIONS

This application is a continuation of International Application No. PCT/US2015/045316, filed on Aug. 14, 2015, which claims the benefit of U.S. Provisional Application No. 62/037,913, entitled "Multi-Inlet, Multi-Spray Fluidic Cup Nozzle with Shared Interaction Region and Spray Generation Method", filed on Aug. 15, 2014, the entire contents of which are hereby incorporated by reference. This application is also related to the following commonly owned patent applications:

(a) U.S. provisional application No. 61/476,845, filed Apr. 19, 2011 and entitled Method and Fluidic Cup apparatus for creating 2-D or 3-D spray patterns, (b) PCT application no. PCT/US12/34293, filed Apr. 19, 2012 and entitled Cup-shaped Fluidic Circuit, Nozzle Assembly and Method (WIPO Pub WO 2012/145537), (c) U.S. application Ser. No. 13/816,661, filed Feb. 12, 2013, Cup-shaped Fluidic Circuit, Nozzle Assembly and Method, (d) U.S. application Ser. No. 14/229,496, filed Mar. 28, 2014, and entitled Cup-shaped Nozzle Assembly with Integral Filter Structure, and (e) PCT application no. PCT/US14/32286, filed 29 Mar. 2014, and entitled Cup-shaped Nozzle Assembly with Integral Filter and Alignment Features (WIPO Pub WO/2014/160992), the entire disclosures of which are hereby incorporated herein by reference.

FIELD OF THE INVENTION

The present invention relates generally to transportable or disposable liquid or fluid product dispensers and nozzle assemblies adapted for use with liquid or fluid product sprayers, and more particularly to such sprayers having nozzle assemblies configured for dispensing or generating sprays of selected fluids or liquid products in a desired spray pattern from multiple inlets through a shared interaction chamber to multiple outlets.

BACKGROUND

Cleaning fluids, hair spray, skin care products and other liquid products are often dispensed from disposable, pressurized or manually actuated sprayers which can generate a roughly conical spray pattern or a straight stream. Some dispensers or sprayers have an orifice cup with a discharge orifice through which product is dispensed or applied by sprayer actuation. For example, the manually actuated sprayer of U.S. Pat. No. 6,793,156 to Dobbs, et al illustrates an improved orifice cup mounted within the discharge passage of a manually actuated hand-held sprayer. The cup is held in place with its cylindrical side wall press fitted within the wall of a circular bore. Dobbs' orifice cup includes "spin mechanics" in the form of a spin chamber and spinning or tangential flows there are formed on the inner surface of the circular base wall of the orifice cup. Upon manual actuation of the sprayer, pressures are developed as the liquid product is forced through a constricted discharge passage and through the spin mechanics before issuing through the discharge orifice in the form of a traditional conical spray. If the liquid product is susceptible to congealing or clogging, the spray is often not consistent and unsatisfactory, especially when first spraying the product, or during "start-up."

If no spin mechanics are provided or if the spin mechanics feature is immobilized (e.g., due to product clogging), the liquid issues from the discharge orifice in the form of a stream. Typical orifice cups are molded with a cylindrical skirt wall, and an annular retention bead projects radially outwardly of the side of the cup near the front or distal end thereof. The orifice cup is typically force fitted within a cylindrical bore at the terminal end of a discharge passage in tight frictional engagement between the cylindrical side wall of the cup and the cylindrical bore wall. The annular retention bead is designed to project into the confronting cylindrical portion of the pump sprayer body serving to assist in retaining the orifice cup in place within the bore as well as in acting as a seal between the orifice cup and the bore of the discharge passage. The spin mechanics feature is formed on the inner surface of the base of the orifice cup to provide a swirl cup which functions to swirl the fluid or liquid product and break it up into a substantially conical spray pattern.

A manually pumped trigger sprayer is disclosed in U.S. Pat. No. 5,114,052 to Tiramani, et al, which illustrates a trigger sprayer having a molded spray cap nozzle with radial slots or grooves which swirl the pressurized liquid to generate an atomized spray from the nozzle's orifice.

Other spray heads or nebulizing nozzles used in connection with disposable, manually actuated sprayers are incorporated into propellant pressurized packages, including aerosol dispensers such as are described in U.S. Pat. No. 4,036,439 to Green and U.S. Pat. No. 7,926,741 to Laidler et al. All of these spray heads or nozzle assemblies include a swirl system or swirl chamber which work with a dispensing orifice through which a fluid is discharged from the dispenser member. The recesses, grooves or channels defining the swirl system co-operate with the nozzle to entrain the liquid or fluid to be dispensed in a swirling movement before it is discharged through the dispensing orifice. The swirl system is conventionally made up of one or more tangential swirl grooves, troughs, passages or channels opening out into a swirl chamber accurately centered on the dispensing orifice so that the pressurized fluid is swirled and discharged through the dispensing orifice. U.S. Pat. No. 4,036,439 to Green describes a cup-shaped insert with a discharge orifice which fits over a projection having grooves defined in the projection, so that a swirl cavity is defined between the projection and the cup-shaped insert. Such swirl cavities only work when the liquid product flows evenly, however, and if the liquid product is susceptible to congealing or clogging, the spray is often not consistent and thus is unsatisfactory, especially when first spraying the product, or during "start-up."

All of these nozzle assembly or spray-head structures with swirl chambers are configured to generate substantially conical atomized or nebulized sprays of fluid or liquid in a continuous flow over the entire spray pattern, and droplet sizes are poorly controlled, often generating "fines" or nearly atomized droplets. Other spray patterns (e.g., a narrow oval which is nearly linear) are possible, but the control over the spray's pattern is limited. None of these prior art swirl chamber nozzles can generate an oscillating spray of liquid or provide precise sprayed droplet size control or spray pattern control. There are several consumer products packaged in aerosol sprayers and trigger sprayers where it is desirable to provide customized, precise liquid product spray patterns.

Oscillating fluidic sprays have many advantages over conventional, continuous sprays, and can be configured to generate an oscillating spray of liquid or provide a precise sprayed droplet size control or precisely customized spray pattern for a selected liquid or fluid. The applicants have been approached by liquid product makers who want to provide those advantages, but prior art fluidic nozzle assemblies have not been configured for incorporation with disposable, manually actuated sprayers.

In applicants' durable and precise prior art fluidic circuit nozzle configurations, a fluidic nozzle is constructed by assembling a planar fluidic circuit or insert into a weatherproof housing having a cavity that receives and aims the fluidic insert and seals the flow passage. A good example of a fluidic oscillator-equipped nozzle assembly, as used in the automotive industry, is illustrated in commonly owned U.S. Pat. No. 7,267,290 (see, e.g., FIG. 3) which shows how a planar fluidic circuit insert is received within and aimed by a housing.

Fluidic circuit generated sprays could be very useful in disposable, manually actuated sprayers, but adapting prior art fluidic circuits and fluidic circuit nozzle assemblies to such devices would require engineering and manufacturing process changes to the currently available disposable, manually actuated sprayers, thus making them too expensive to produce at a commercially reasonable cost. Disposable sprayers of fluid products must be easy to use, and so trigger effort must be kept low, a problem which is separate from a product vendor's perceived needs to (a) provide controlled sprays with a selected droplet size range (e.g., DV50 between 20 μm and 180 μm) and (b) maintain a compact package space. Fluid product vendors also want to provide a means of entraining air directly into the nozzle outlet throat to generate a foamed spray (with a selected "richness" of lather) without the addition of an external foaming 'engine' or venture feature. Adding an external foaming engine is the commonly provided method for foaming consumer sprays but external foaming engines add costs and require additional components and increase assembly complexity.

There is a need, therefore, for a commercially reasonable and inexpensive, disposable, manually actuated sprayer or nozzle assembly and spray generation method which overcomes the problems with the prior art.

SUMMARY

Accordingly, it is an object of the present invention to overcome the above mentioned difficulties by providing a commercially reasonable, inexpensive, disposable, manually actuated cup-shaped nozzle assembly, and a corresponding spray generation method, adapted for use with optional fluidic circuit configurations which provide the advantages of selected spray patterns for given liquid or fluid products. The nozzle assemblies and methods of the present invention give a designer/manufacturer the ability to have lower trigger effort on trigger sprays while maintaining a selected droplet size range (e.g., DV50 between 20 μm and 180 μm) by splitting flow rates between two fluidic oscillators within the same package space. Thus, in the present invention, multiple inlets are combined with multiple or larger outlets to allow more viscous fluids (like cooking oil, lotions or paints), with viscosities ranging from 1-80 cps, to be sprayed at lower trigger spray efforts or lower BOV and aerosol supply pressures. In addition, the features of the present invention produce smaller droplets at larger flow rates which can benefit products distributed by aerosol or bag on valve (BOV) delivery systems. This invention also provides a mechanism for entraining air directly into a nozzle outlet throat to generate a foamed spray (with a selected "richness" of lather) without the addition of an external foaming 'engine' or venture feature. Such an external foaming engine is the more common method for foaming consumer sprays at the present time, but adds costs and components.

In accordance with the present invention, a conformal, cup-shaped fluidic oscillator spray nozzle is engineered to generate one or more oscillating sprays and is configured as a cylindrical cup having a substantially open proximal end and a substantially closed distal end wall with one or more centrally located orifices defined therein. A multi-input, multi-output cup-shaped fluidic oscillator embodiment, configured to generate a selected fluid spray from a plurality of (e.g., 2-8) fluid product inlets which are configured in interacting pairs and feed into a common interaction chamber or region, is defined within the fluidic nozzle's geometry. The nozzle is optionally configured with a selected number of outlets (e.g., one to four) that dictate spray coverage pattern and distribution, where outlet geometry is chosen so that sprays from each outlet are aimed to avoid external interaction of distinct oscillating spray streams, to avoid colliding droplets and to preserve the selected droplet size generated by each outlet's oscillating spray. Optionally, an outlet can be positioned in the interaction region and have a specific geometry to allow for air entrainment into the interaction region and/or external oscillating spray streams to generate a foamed spray of fluid product.

The nozzle cup's features or fluid channel defining geometry are preferably molded directly into a cup-shaped member which is then affixed to a fluid product dispensing package's actuator. This eliminates the need for an assembly made from a fluidic circuit-defining insert which is received within a housing cavity. The present invention provides a novel cup with, optionally, a multi-inlet, multi-outlet fluidic circuit which functions like a planar fluidic circuit but which has the fluidic circuit's oscillation-inducing features configured within the cup-shaped member. The multi-inlet, multi-outlet cup is useful with both hand-pumped trigger sprayers and propellant filled aerosol sprayers and can be configured to generate different sprays for different liquid or fluid products. A multi-inlet, multi-outlet cup can be configured to project a plurality of desired spray patterns (e.g., 3-D or rectangular oscillating patterns of uniform droplets). The multi-inlet, multi-outlet cup-shaped nozzle reliably overcomes difficult-to-operate spray problems for liquid products. Optionally, the fluidic oscillator structure's fluid dynamic mechanism for generating the oscillation is conceptually similar to that shown and described in commonly owned U.S. Pat. Nos. 7,267,290 and 7,478,764 (Gopalan et al) which describe a planar mushroom fluidic circuit's operation; both of these patents are hereby incorporated herein in their entireties by reference.

In the exemplary embodiments illustrated herein, a multi-inlet, multi-outlet fluidic cup oscillator is configured to be force fitted within an actuator's cylindrical bore at the terminal end of a discharge passage in tight frictional engagement between the cylindrical side wall of the cup and the cylindrical bore wall of the actuator. An optional annular retention bead on the cup may project into a confronting cylindrical groove or trough retaining portion of the actuator or pump sprayer body, serving to assist in retaining the fluidic cup in place within the bore as well as in acting as a seal between the fluidic cup and the bore of the discharge passage. The fluidic oscillator features or geometry are formed on the inner surface(s) of the multi-inlet, multi-outlet fluidic cup to provide a fluidic oscillator which functions to generate one or more oscillating sprays having selected spray patterns of droplets of uniform, selected size.

The multi-inlet, multi-outlet fluidic circuit of the present invention is preferably molded as a conformal, one-piece cup-shaped member. There are several consumer applications, like aerosol sprayers and trigger sprayers, where it is desirable to customize sprays. Fluidic sprays are very useful in these cases but adapting typical commercial aerosol sprayers and trigger sprayers to accept the standard fluidic oscillator configurations would cause unreasonable product manufacturing process changes to current aerosol sprayers and trigger sprayers, thus making them much more expensive. The multi-inlet, multi-outlet fluidic cup configuration of the present invention conforms to the actuator stem used in typical aerosol sprayers and trigger sprayers and so replaces the prior art "swirl cup" that goes over the actuator stem, and accordingly the benefits of using a multi-inlet, multi-outlet fluidic oscillator nozzle assembly are made available with little or no significant changes to other parts. With the multi-inlet, multi-outlet fluidic cup and method of the present invention, vendors of liquid products and fluids sold in commercial aerosol sprayers and trigger sprayers can now provide very specifically tailored or customized sprays.

A typical nozzle assembly or spray head includes a lumen or duct for dispensing or spraying a pressurized liquid product or fluid from a valve, pump or actuator assembly which draws fluid from a disposable or transportable container to generate an outlet spray. The spray head includes an actuator body and a distally projecting sealing post having a post peripheral wall terminating at a distal or outer face. The actuator body includes a fluid passage communicating with the lumen.

In accordance with the invention, a cup-shaped multi-inlet, multi-outlet fluidic circuit is mounted in the actuator body member, and incorporates a peripheral wall extending proximally into a bore in the actuator body radially outwardly of the sealing post. The peripheral wall carries a distal radial wall comprising an inner face opposing the sealing post distal or outer face to define a fluid channel including a chamber having an interaction region between the body sealing post and the cup-shaped fluidic circuit's peripheral wall and distal wall. The chamber is in fluid communication with the actuator body's fluid passage to define a fluidic circuit oscillator inlet so that pressurized fluid from the actuator assembly can enter the fluid channel's chamber and interaction region. The fluidic cup structure has a fluid inlet within the cup's proximally projecting cylindrical sidewall, and in one example the fluid inlet is substantially annular and of constant cross section; however, the fluidic cup's fluid inlet can also be tapered or include step discontinuities (e.g., with an abruptly smaller or stepped inside diameter) to enhance the pressurized fluid's instability.

The cup-shaped inner face of the distal wall of the fluidic circuit either supports an insert having, or carries, a multi-inlet, multi-outlet fluidic geometry, so it is configured to define the multi-inlet, multi-outlet fluidic oscillator's operating features or geometry within the chamber. It should be emphasized that any fluidic oscillator geometry which defines an interaction region to generate an oscillating spray of fluid droplets can be used, but, for purposes of illustration, conformal cup-shaped fluidic oscillators having selected exemplary fluidic oscillator geometries will be described in detail.

In accordance with the conformal cup-shaped multi-inlet, multi-outlet fluidic oscillator embodiments of the present invention, a conformal fluidic cup's chamber includes a first power nozzle (inlet) pair and a second power nozzle (inlet) pair, where each power nozzle is configured to accelerate the movement of passing pressurized inlet fluid flowing through the power nozzle geometry to form corresponding jets of fluid flowing into the chamber's interaction region. The fluid jets impinge upon one another at a selected inter-jet impingement angle (e.g., 180 degrees, meaning the jets impinge from opposite sides) in the interaction region and generate oscillating flow vortices within it. The fluid channel's interaction region is in fluid communication with one or more discharge orifices or outlets defined in the fluidic circuit's distal wall, and the oscillating flow vortices eject, or spray, droplets through the discharge orifice(s) in the form of oscillating spray(s) of substantially uniform fluid droplet size in selected spray patterns having selected spray width and selected spray thickness.

Preferably, the power nozzles are venturi-shaped or tapered channels or grooves in the inner face of the distal wall of the cup-shaped fluidic circuit and all terminate in a common, nearly rectangular or box-shaped interaction region defined in that inner face. The interaction region configuration affects the spray pattern(s).

The cup-shaped fluidic circuit power nozzles, interaction region and discharge outlet(s) can be defined in a disk or pancake-shaped insert fitted within the cup, but are preferably molded directly into the cup's interior wall segments. When molded from plastic as a one-piece, cup-shaped, multi-inlet, multi-outlet fluidic circuit, the fluidic cup is easily and economically fitted onto the actuator's sealing post, which typically has a distal or outer face that is substantially flat and fluid impermeable. The sealing post is then in flat face sealing engagement with the cup-shaped fluidic circuit distal wall's inner face. The sealing post's peripheral wall and the cup-shaped fluidic circuit's peripheral wall are coaxial and are radially spaced to define an annular fluid channel therebetween. These peripheral walls are generally parallel with each other but the annular space may be tapered to aid in developing greater fluid velocity to create fluidic flow instability and thus oscillation.

As a multi-inlet, multi-outlet fluidic circuit item for sale or shipment to others, the conformal, unitary, one-piece fluidic circuit is configured for easy and economical incorporation into a nozzle assembly or aerosol spray head actuator body which has a distally projecting sealing post and a lumen for dispensing or spraying a pressurized liquid product or fluid from a disposable or transportable container to generate an oscillating spray of fluid droplets. As described above, this fluidic circuit item includes a cup-shaped multi-inlet, multi-outlet fluidic circuit member having a peripheral wall extending distally, or axially, and having a distal radially-extending wall having an inner face with fluidic circuit features defined therein and an open proximal end configured to receive an actuator's sealing post. The cup-shaped member's peripheral wall and distal radial wall have inner surfaces forming at least one fluid channel and a chamber when the cup-shaped member is fitted to the actuator body sealing post. The chamber is configured to define multiple fluidic circuit oscillator channels or power nozzles in fluid communication at their inlet ends with the fluid channel and at their outlet ends with a common interaction region so that when the cup-shaped member is fitted to the actuator body sealing post and pressurized fluid is introduced, (e.g., by pressing the aerosol spray button and releasing the propellant), the pressurized fluid can enter the fluid channel's chamber and interaction region and generate at least one oscillating flow vortex within the interaction region.

The cup shaped member's distal wall includes at least one discharge orifice and, in the illustrated forms of the present invention, multiple discharge orifices in fluid communication with the chamber's interaction region to provide multiple fluid spray outputs. The internal chamber is configured so that when the multi-inlet, multi-outlet cup-shaped member is fitted to the actuator body sealing post and pressurized fluid is introduced via the actuator body, the chamber's fluidic oscillator inlet is in fluid communication with the multiple power nozzles which are configured to accelerate the movement of passing pressurized fluid to form jets of fluid flowing into the chamber interaction region, where the jets impinge upon one another at a selected inter jet impingement angle to generate oscillating flow vortices within interaction region. As before, the chamber's interaction region is in fluid communication with one or more discharge orifices defined in the fluidic circuit's distal wall, and the oscillating flow vortices flow out of the discharge orifice(s) as oscillating sprays of substantially uniform fluid droplets, each spray having a selected spray width and a selected spray thickness.

In the method of the present invention, liquid product manufacturers making or assembling a transportable or disposable pressurized package for spraying or dispensing a liquid product, material or fluid would first obtain or fabricate a conformal multi-inlet, multi-outlet fluidic cup circuit for incorporation into an aerosol spray head actuator body, which typically includes a standard distally projecting sealing post. The actuator body has a lumen for dispensing or spraying a pressurized liquid product or fluid from a disposable or transportable container to generate a spray of fluid droplets. The conformal multi-inlet, multi-outlet fluidic circuit includes the above-described cup-shaped fluidic circuit member having a peripheral wall extending axially and distally, and having a distal radial or end wall that incorporates an inner face with fluidic circuit features defined therein. The cup-shaped member has an open proximal end configured to receive the actuator sealing post. The cup-shaped member's peripheral wall and distal radial wall have inner surfaces defining a fluid channel including a chamber with a multiple fluidic circuit inlets in fluid communication with an interaction region.

In the preferred embodiment of the assembly method, the product manufacturer or assembler next provides or obtains an actuator body with the distally projecting sealing post centered within a body segment to resiliently receive and retain the multi-inlet, multi-outlet cup-shaped member. The next step is inserting the sealing post into the cup-shaped member's open proximal end and engaging the actuator body to enclose and seal the fluid channel with the chamber and the multi-inlet, multi-outlet fluidic circuit oscillators with their inlets or power nozzles in fluid communication with the interaction region. A test spray can be performed to demonstrate that when pressurized fluid is introduced into the fluid channel, the pressurized fluid enters the chamber and interaction region and generates at least one oscillating flow vortex within the fluid channel's interaction region.

In the preferred embodiment of the assembly method, the fabricating step comprises molding a cup-shaped member of a plastic material to form a conformal multi-inlet, multi-outlet fluidic circuit to thereby provide a conformal, unitary, one-piece cup-shaped fluidic circuit member having a distal radial wall with inner face features molded therein so that the cup-shaped member's inner surfaces provide an oscillation-inducing geometry which is molded directly into the cup's interior wall segments.

The above and still further objects, features and advantages of the present invention will become apparent upon consideration of the following detailed description of specific embodiments, particularly when taken in conjunction with the accompanying drawings, wherein like reference numerals in the various figures are utilized to designate like components.

DETAILED DESCRIPTION

Figure 1A:
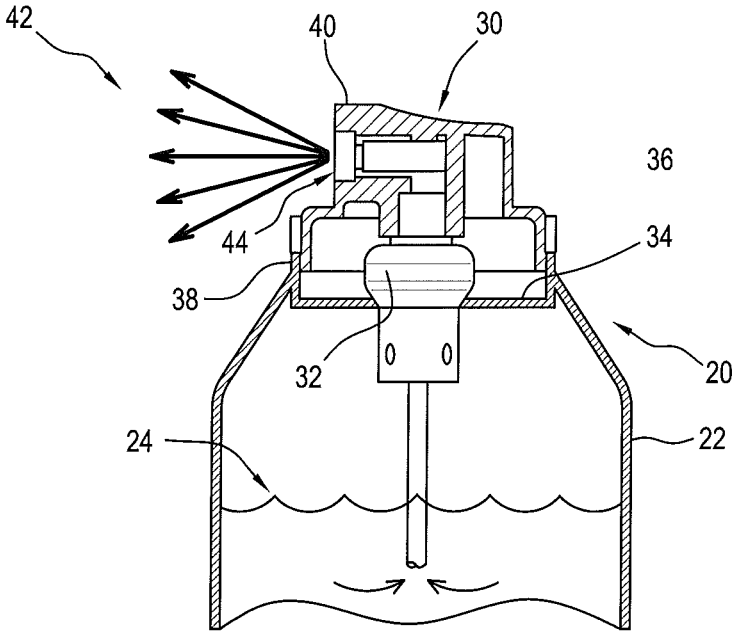
FIG. 1A (PRIOR ART)
FIG. 1A, is a cross sectional view in elevation of an aerosol sprayer with a typical valve actuator and swirl cup nozzle assembly, in accordance with the Prior Art.
Figure 1B:
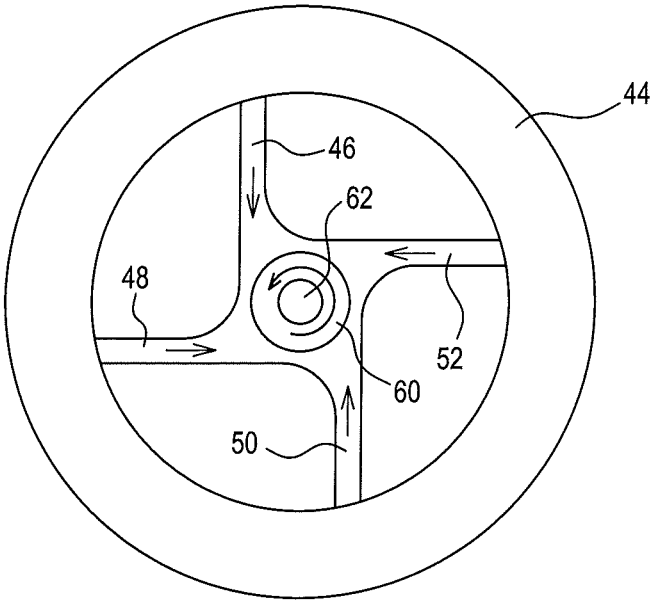
FIG. 1B (PRIOR ART)
FIG. 1B, is a plan view of a standard swirl cup as used with aerosol sprayers and trigger sprayers, in accordance with the Prior Art.
Figure 1C:
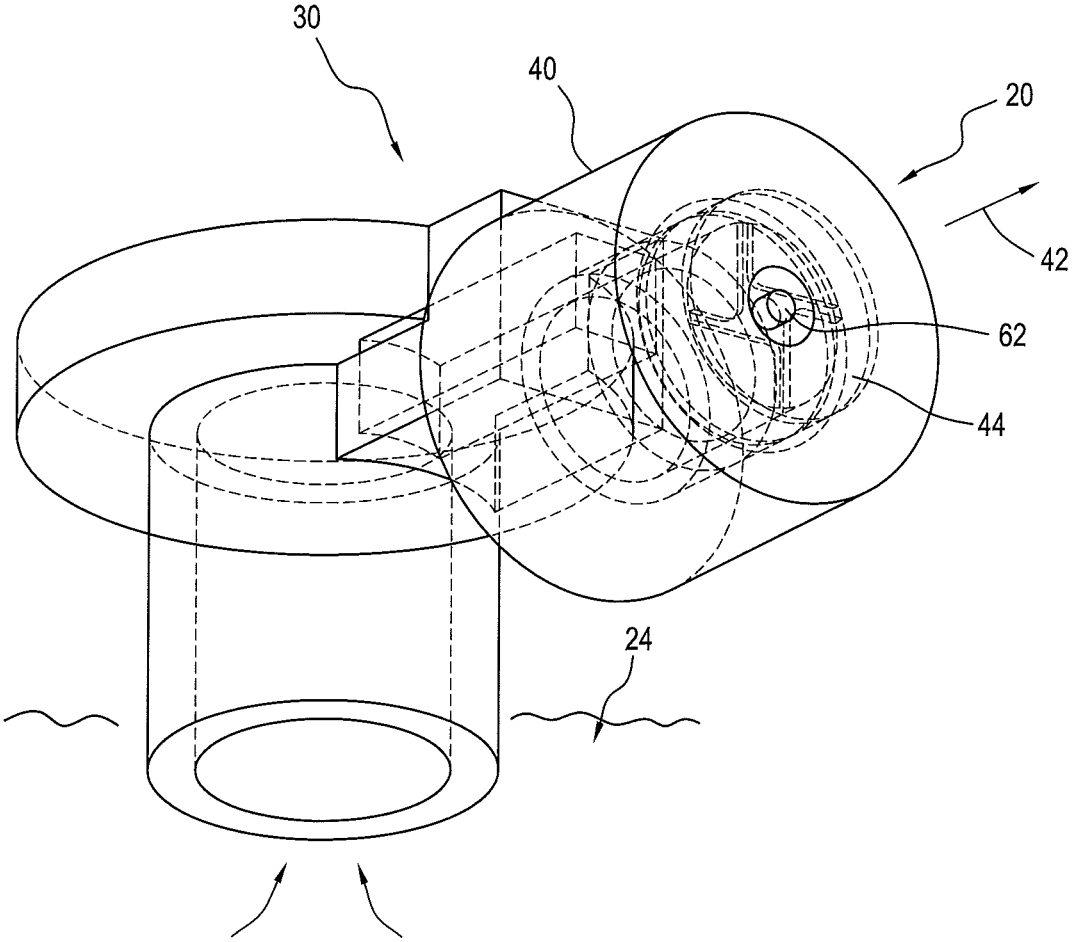
FIG. 1C (PRIOR ART)
FIG. 1C is a schematic diagram illustrating a typical actuator and nozzle assembly including the standard swirl cup of FIGS. 1A and 1B as used with aerosol sprayers, in accordance with the Prior Art.

FIGS. 1A, 1B, 1C and D show typical features of aerosol spray actuators and swirl cup nozzles used in the prior art, and these figures are described here to provide added background and context. Referring specifically to FIG. 1A, a typical transportable, disposable propellant pressurized aerosol package 20 has a container 22 enclosing a liquid product 24 and an actuator 30 which controls a valve 32 mounted within a valve cup 34 that is affixed within a neck 36 of the container and supported by container flange 38. Actuator 30 is depressed to open the valve and allow pressurized liquid to pass through a spin-cup equipped nozzle 40 to produce an aerosol spray 42. FIG. 1B illustrates the inner workings of a spin cup 44 used with a typical nozzle 40, where four lumens 46, 48, 50 and 52 are aimed to produce four tangential flows, indicated by arrows in the lumens, which enter a spinning chamber 60 where the continuously spinning liquid flows combine and emerge from a central discharge passage 62 as a substantially the continuous spray 42 containing droplets of varying sizes, including "fines" or miniscule droplets of fluid which many users find to be useless.

FIG. 1C is a schematic perspective diagram illustrating the typical actuator and nozzle assembly of FIGS. 1A and 1B and including the standard swirl cup 44 as used with aerosol sprayers, where the outer surfaces of the actuator and the hidden features including the interior surfaces are diagrammatically illustrated. Such swirl cups 44 are fitted on to a nozzle or actuator (e.g., 40) and may be used not only with an aerosol sprayer (e.g., 20) as illustrated, but also may be used with manually pumped trigger sprayers. It is a simple construction that does not require an insert and separate housing.

Figure 1D:
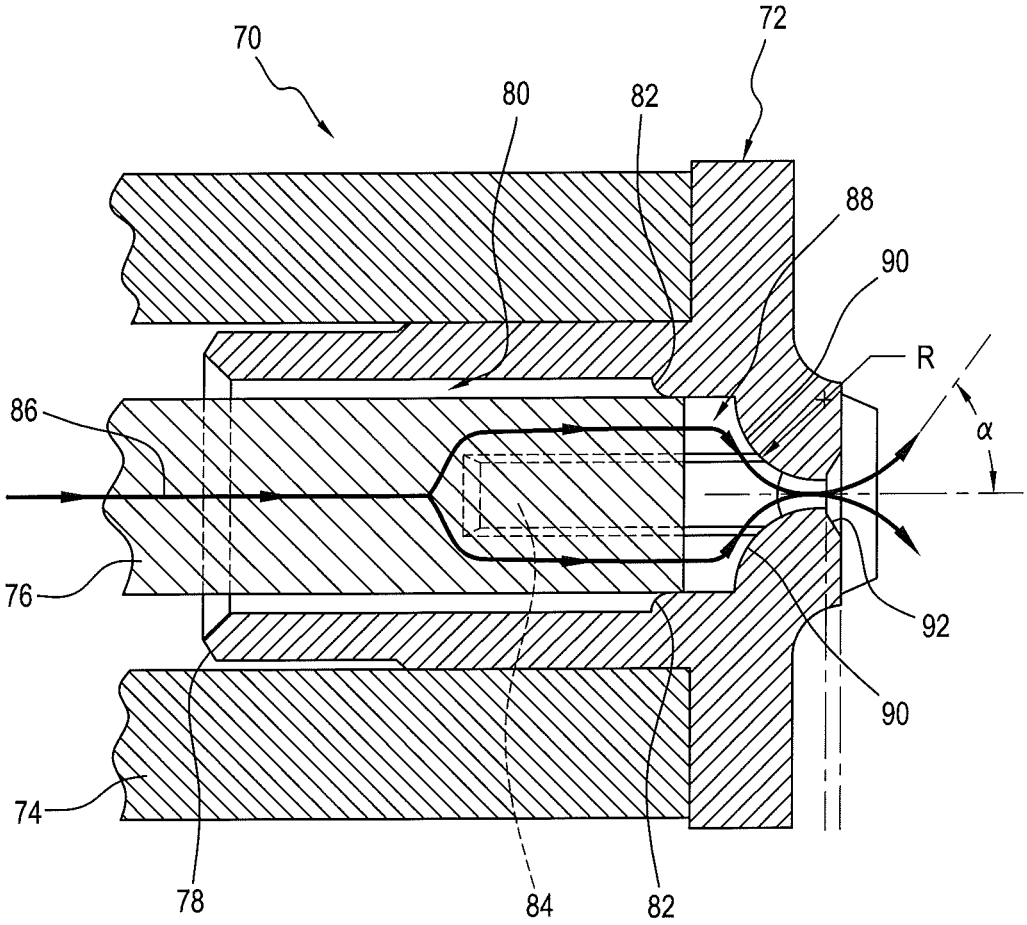
FIG. 1D (PRIOR ART)
FIG. 1D is a cross-sectional view of a spray nozzle insert for a dispenser having an actuator cap, in accordance with the Prior Art.

FIG. 1D illustrates another fluid dispenser nozzle assembly 70 wherein a nozzle insert 72 is used with a tubular fluid dispenser actuator 74 which surrounds a post 76. The insert 72 includes an axially-extending wall 78 that frictionally engages the inner surface of actuator 74 and surrounds and is radially spaced from the center post 76 to define an annular outlet passage 80. The fluid from the dispenser container flows through passage 80 and around centering projections 82 and tabs 84, as indicated by flow arrows 86, into a transition region 88 having shaped shoulders 90 to direct the fluid flow out of nozzle outlet 92.

The fluidic cup oscillator of the present invention improves upon the foregoing concepts illustrated in FIGS. 1A-1D, but provides a structure and method for replacing the "spin" geometry of swirl cup 44 with a fluidic geometry enabling oscillating fluidic sprays instead of a swirl spray. As noted above, swirl sprays are typically round and comprised of droplets of varying sizes and velocities, whereas fluidic sprays are characterized by planar, rectangular or square cross sections with consistent droplet size and velocity. Thus, the spray from a nozzle assembly made in accordance with the present invention can be adapted or customized for various applications and still retains the benefits of simple and economical construction characteristics of traditional "swirl" cups.

Figure 1E:
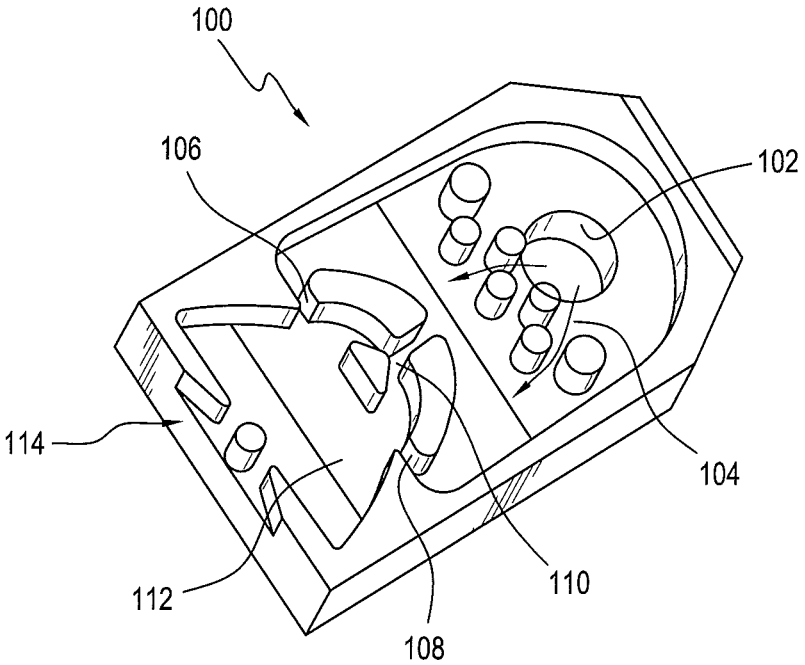
FIG. 1E (PRIOR ART)
FIGS. 1E through 1G are perspective and plan views of prior art fluidic geometries which have operating characteristics that can be emulated by the cup-shaped fluidic oscillator nozzle assembly of the present invention.
Figure 1F:
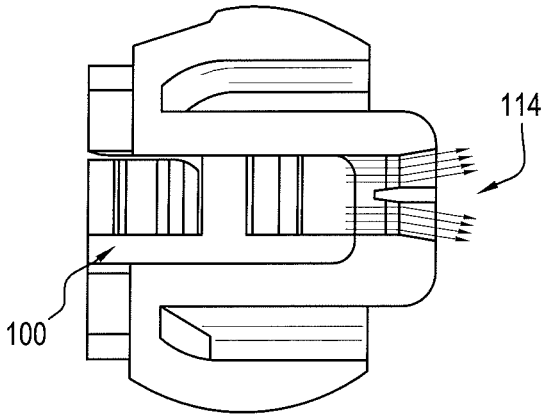
FIG. 1F (PRIOR ART)
Figure 1G:
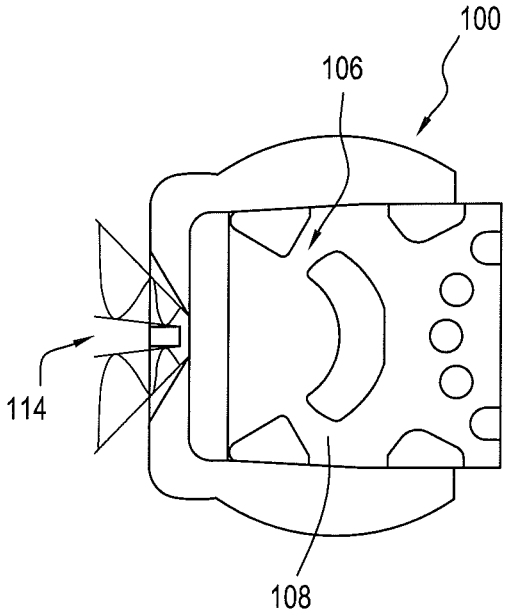
FIG. 1G (PRIOR ART)

Fluidic circuit geometries analogous to applicants' split throat design and suitable for adaptation in the present invention are illustrated at 100 in FIGS. 1E through 1G and the operational characteristics are further described and illustrated in applicants' U.S. Pat. No. 8,172,162, which is hereby incorporated herein by reference. Applicants have developed a fluidic cup which is configured to incorporate structures which are similar to inlet 102 receiving fluid 104 from a container via an actuator, with the fluid flowing through structures which are similar to power nozzles 106, 108, and 110 to a common actuation region 112, and then exiting through an outlet. It will be understood, however, the various fluidic circuit geometries may be adapted for use in the cup-shaped members of the present invention, and those illustrated herein are exemplary, and provided here for purposes of describing a suitable nomenclature.

FIGS. 2-19, to which reference is now made, illustrate applicant's newly developed structural features in exemplary embodiments of the conformal multi-inlet, single or (preferably) multi-outlet fluidic cup oscillators of the present invention and illustrate the method of assembling and using the components of multi-inlet, multi-outlet fluidic oscillator dispensers in accordance with the present invention. Multi-inlet, multi-outlet conformal, cup-shaped fluidic circuit geometries which emulate applicants' widely appreciated planar fluidic geometry configurations, but which have been engineered to generate one or more desired oscillating sprays from a conformal configuration such as a fluidic cup are described herein. In accordance with the present invention, then, a fluidic oscillator cup nozzle for producing a fluid spray includes a plurality of inlets (e.g., 2 to 6 inlets) that feed into a common interaction region of the fluidic nozzle geometry. The fluidic cup nozzle with multiple inlets and a shared interaction region has fluid product feed channels in fluid communication with a pressurized fluid supply from a source (e.g., dispensing valve/trigger sprayer container 22), and the feed channels are each in fluid communication with multiple inlet nozzles, or power nozzles, within the fluidic circuit dispenser assembly. All of the inlets (or power nozzles) define lumens which are in fluid communication with and feed into a common interaction region to generate bi-stable oscillating jets of fluid product which exit from at least one, and preferably multiple outlets as a dispensed spray.

Figure 2:
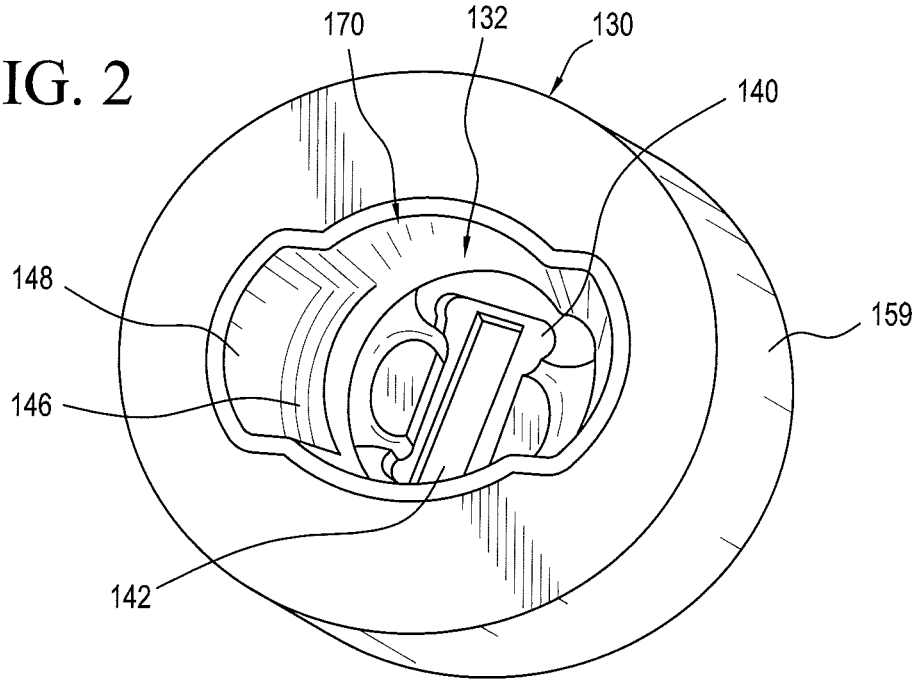
FIG. 2 is a perspective view illustrating the interior surfaces of a multi-inlet, single-outlet fluidic cup oscillator spray nozzle member, showing oscillation-inducing geometry or features for a selected fluidic oscillator in accordance with a first embodiment of the present invention.
Figure 3:
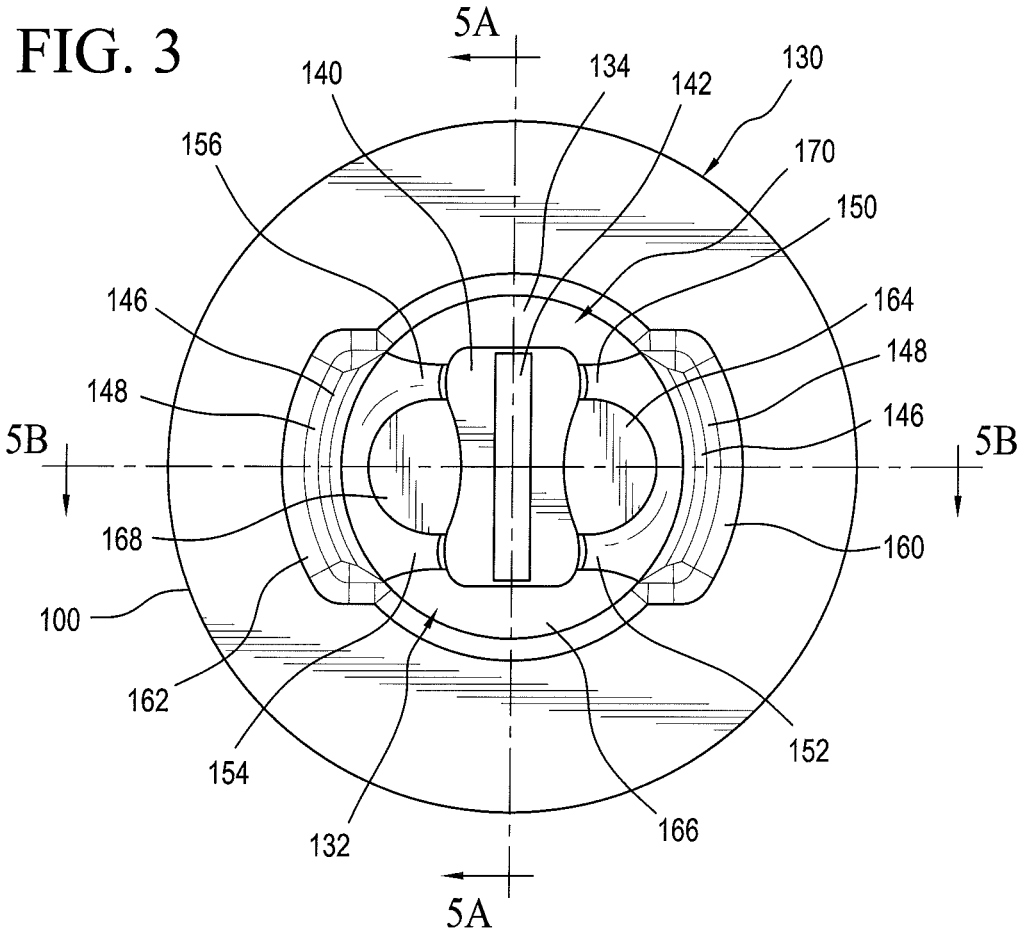
FIGS. 3 and 4 are plan-view diagrams of the embodiment of FIG. 2, showing the interior surfaces of the multi-inlet, single-outlet fluidic cup's distal wall and interior fluidic geometry.
Figure 4:
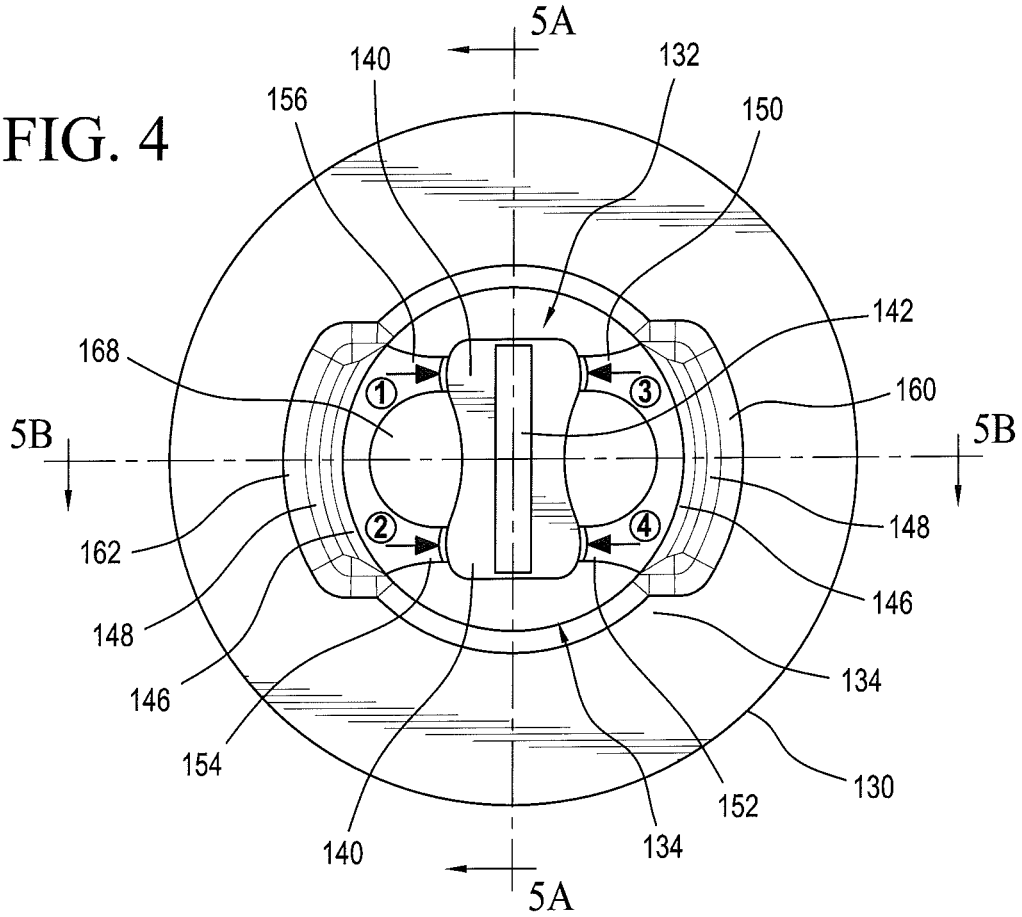
Figure 5A:
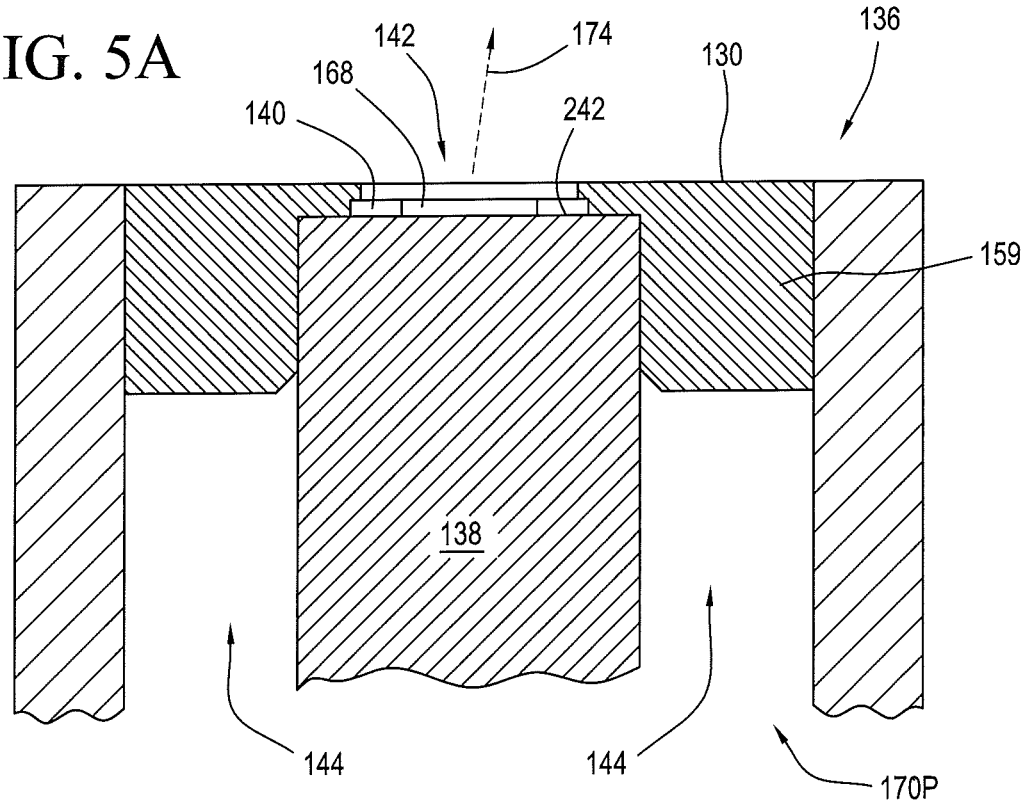
FIGS. 5A and 5B are mutually orthogonal cross-sectional views of the conformal, one-piece cup-shaped member embodiment of FIGS. 3 and 4, showing the fluidic cup installed or mounted in a dispenser actuator on the actuator body's sealing post member, in accordance with the present invention.
Figure 5B:
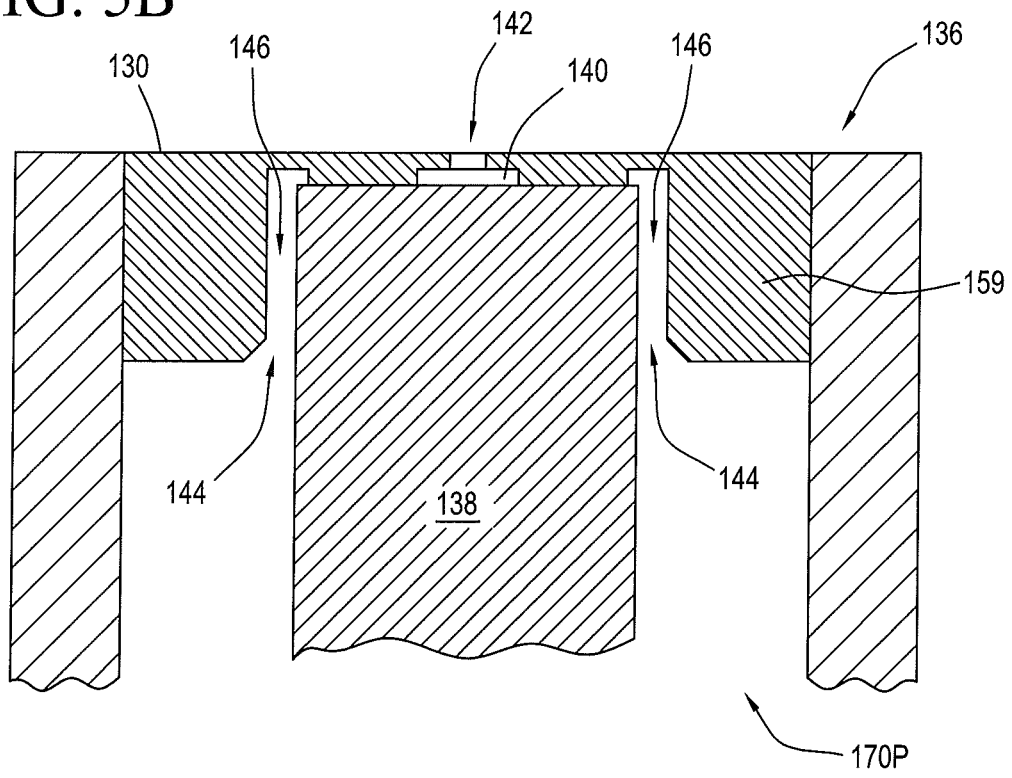

Referring particularly to FIGS. 2, 3, 4, 5A and 5B, a multi-inlet single outlet conformal, cup shaped dispenser nozzle member or fluidic cup 130 is illustrated, FIG. 2 being a perspective view of the interior of the fluidic cup, and FIGS. 3 and 4 being plan views, looking in the direction of fluid flow from an actuator into the fluidic cup and viewing a fluid oscillator geometry, generally indicated at 132, which is molded in the interior of a transverse distal wall 134 as a part of the fluidic cup. FIGS. 5A and 5B are mutually orthogonal cross sectional views of a modified version of fluidic cup 130 taken generally along line 5A-5A and 5B-5B of FIG. 4, and each view includes a portion of the dispenser actuator in which the insert is mounted. The cross section illustrated in FIG. 5A is taken generally along line 5A-5A of FIG. 4 and the cross section illustrated in FIG. 5B is taken generally along line 5B-5B of FIG. 4, where the plane defined along line 5A-5A is transverse to or orthogonal to the plane along line 5B-5B. The fluidic cup 130 preferably is configured as a one-piece, injection-molded plastic, fluidic cup-shaped conformal nozzle member which does not require a multi-component insert and housing assembly. The fluidic oscillator's operative features 132 are preferably molded directly into the cup's interior surfaces and the cup is configured for easy installation into an actuator body 136 of the type typically having a distally projecting cylindrical post 138, as illustrated in FIGS. 5A and 5B.

The novel fluidic circuit 132 provides a multi-inlet, single outlet fluidic cup embodiment which has a shared interaction region 140 which is part of the fluidic circuit's oscillation inducing geometry that is molded in-situ within the cup-shaped member. Once installed on a sealing post 138 in an actuator 136, a complete and effective fluidic oscillator nozzle is thereby provided. The interaction region 140 of the one-piece multi-inlet, single-outlet fluidic cup oscillator insert 130 has an elongated exit or discharge port 142 proximate the shared interaction region 140. The fluidic circuit 132 is shaped to direct fluid flow, indicated by arrows 144 in FIGS. 5A and 5B, from the actuator 136 through first and second cup sidewall passages 146 which define distally projecting lumens surrounding post 138 that are in fluid communication with opposing tapered venturi-shaped power nozzles 150, 152, 154, and 156 (see FIGS. 2-4 and 5B). The distal fluid flow 144 issues from power nozzles 150, 152, 154, and 156 and into the shared interaction region 140, where the fluid from each power nozzle 150, 152, 154, and 156 is in fluid communication with, and interacts with, fluid flow from the other power nozzles within the shared interaction region 140 defined in the interior surface of distal end-wall 134. The end wall 134 may be circular, planar or disc-shaped, and includes molded grooves or troughs on its inner surface which define the four inlets or power nozzles 150, 152, 154, and 156 of the oscillation-inducing geometry 132.

The fluidic circuit 132 geometry is preferably defined in distal end wall 134 and is downstream of and encircled by substantially cylindrical sidewall segments 160, 162, which, once cup member 130 is inserted, frictionally engage the interior surface of the annular actuator 136 to secure the conformal one-piece cup-shaped member 130 to the dispenser outlet. Although the conformal one-piece cup-shaped member 130 is illustrated in FIGS. 2-5B as incorporating a pair of opposed sidewall segments, it will be understood that a single substantially cylindrical sidewall 159 may be used, as illustrated in FIGS. 2, 5A and 5B, or that more than two sidewall segments may be provided. The sidewall or sidewall segments, define the cup member's open proximal end 170 (FIGS. 2 and 3) which receives fluid from the fluid supply of the dispenser actuator and the cup member's cylindrical sidewall 159 terminates distally in closed distal end or wall 134 which incorporates the substantially centered elongated slot-like distal discharge port, exit orifice or throat 142 defined therethrough so that exit orifice or discharge port 142 is aimed distally and directs fluid spray 174 distally out of the port. The one-piece fluidic cup oscillator member 130 is optionally configured with first and second parallel opposing substantially planar "wrench-flat" segments (not shown) defined in distally projecting cylindrical sidewall segments 160, 162.

As noted above, the shared interaction chamber 140 in the embodiment of FIGS. 2-5B is in fluid communication with the actuator body's fluid passage 170P through a plurality (e.g., two distally projecting lumens 146 which are in fluid communication with multiple (e.g., four) tapered inlet passageways, or power nozzles (e.g., 150, 152, 154, and 156) so that pressurized fluid 144 to be sprayed is directed distally over the fluid impermeable external sidewall and distal end face (242) surfaces of sealing post 138 and is forced into the shared interaction chamber 140. The power nozzles are defined in the distal wall 134 within member 130 by the plurality of proximally-projecting, inlet defining wall segments or mesas 164, 166, 168 and 170 (FIG. 3). More particularly, inwardly projecting segments or mesas 170 and 164 are configured and spaced to define the first power nozzle 150, while segments 164 and 166 define power nozzle 152, segments or mesas 166 and 168 define power nozzle 154, and segments or mesas 168 and 170 define power nozzle 156. The segments or mesas are configured and spaced to define tapering nozzle side walls which define lumens of decreasing cross sectional area (tapering inwardly) to provide a venturi effect for accelerating and aiming pressurized fluid flowing through the nozzles into the shared interaction chamber 140.

Shared, multi-inlet interaction chamber 140 is thus in fluid communication with the multiple inlets or power nozzles 150, 152, 154, and 156 defined in the cup-shaped member's distal wall as lumens between spaced mesas, so that when pressurized with fluid product, the first power nozzle fluid flow is combined with the second power nozzle fluid flow, the third power nozzle fluid flow and the fourth power nozzle fluid flow to generate a plurality of unstable fluid vortices within said shared interaction chamber 140. The unstable fluid vortices in the shared interaction chamber 140 collide with the incoming fluid jets from the power nozzle fluid flows to generate an oscillating escaping fluid flow which exhausts from the discharge orifice 142 as a spray of fluid droplets in a selected spray pattern 174.

In the fluidic cup embodiment 130 of FIGS. 2-5B, applicants have effectively developed a surprisingly effective improvement over the typical four channel swirl cup spray device 44 as described and illustrated above. The replacement conformal one-piece cup-shaped member 130 described here and illustrated in these Figures is a four-channel, shared interaction region fluidic oscillator which is configured to generate moving vortices in interaction chamber 140 and operates in a manner similar to the operating principals of applicant's other fluidic circuit geometries. This provides a robust, easily variable spray pattern 174, with a selected droplet size range (e.g., DV50 between 20 μm and 180 μm).

Figure 6:
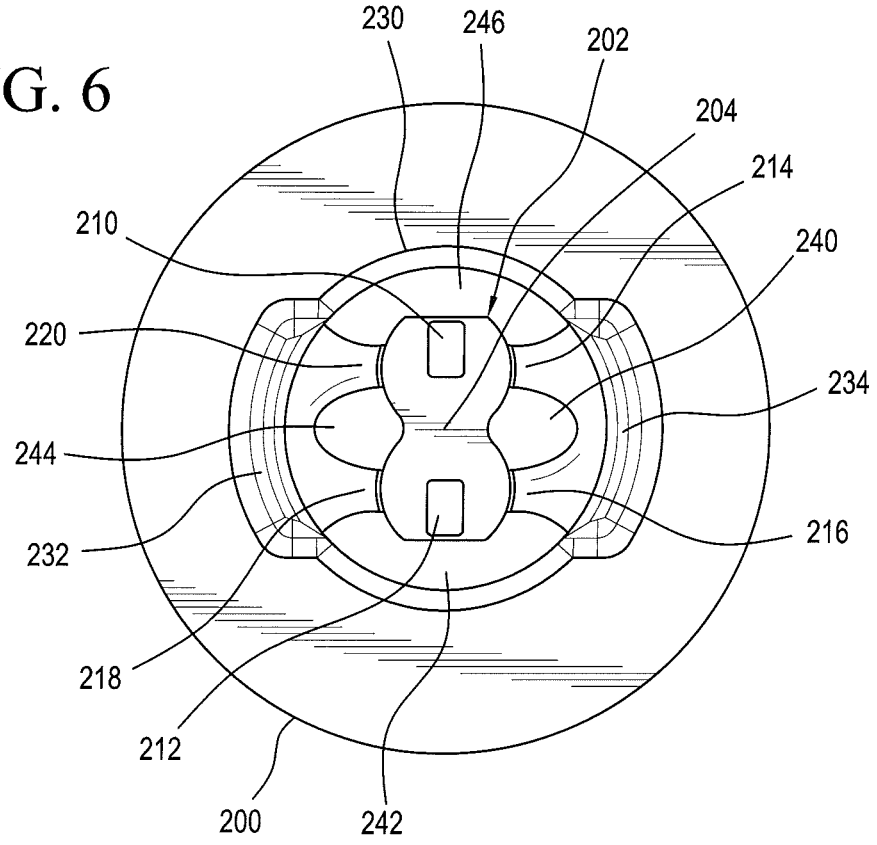
FIGS. 6 and 7 are plan-view diagrams of a second embodiment of the cup-shaped member of the present invention, showing the interior surfaces and interior fluidic geometry providing a multi-input, multi-output cup-shaped fluidic oscillator dispenser or nozzle assembly member, in accordance with the present invention.
Figure 7:
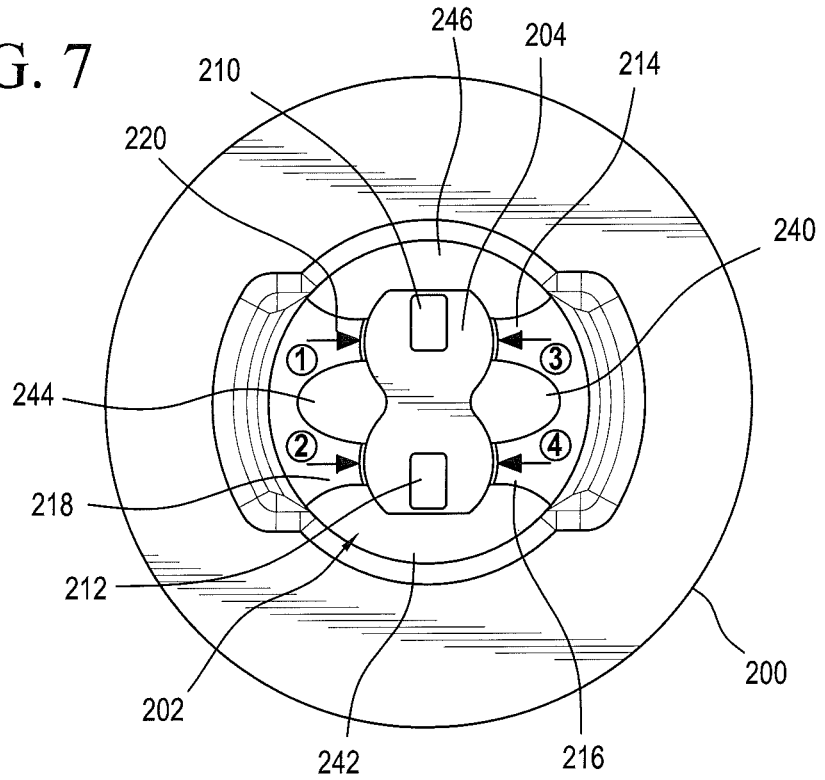

Turning now to FIGS. 6 and 7, another preferred embodiment of the conformal one-piece cup-shaped member 200 is illustrated. This embodiment provides a multi-inlet, multi-outlet cup-shaped nozzle insert or member 200 which is also preferably configured as a one-piece injection-molded plastic fluidic cup-shaped conformal nozzle which does not require a multi-component insert and housing assembly. The operative features of this embodiment include a fluidic oscillator geometry 202 which preferably is molded directly into the interior surface of the member and the conformal one-piece cup-shaped member 200 is configured for easy installation to an actuator body 136 having a sealing post 138, as described with respect to FIGS. 2-5B. The multi-inlet, multi-outlet fluidic cup embodiment 200 illustrated in FIGS. 6 and 7 provides a novel fluidic circuit arrangement which has a shared interaction region 204 as part of the fluidic circuit's oscillation inducing geometry 202 molded in-situ within the cup-shaped member 200 so that once installed on an actuator sealing post 138, a complete and effective fluidic oscillator nozzle is provided. The one-piece multi-inlet, multi-outlet fluidic cup oscillator 200 has first and second exit orifices or discharge ports 210, 212 in fluid communication with and proximate the shared interaction region 204. Tapered venturi-shaped power nozzles 214, 216, 218 and 220 are in fluid communication with fluid 144 supplied from the dispenser actuator (see FIG. 5B) and with the shared interaction region 204, and are in fluid communication with one another within the interior surface of a distal end-wall portion 230. The end wall 230 is circular, planar or disc-shaped, and has a molded interior surface that includes grooves or troughs defined between proximally-extending segments, or mesas to form the four inlet oscillation-inducing power nozzles 214, 216, 218 and 220 of the molded fluidic circuit geometry 210, which is located within substantially cylindrical sidewall segments 232 and 234.

As discussed with respect to the embodiment of FIGS. 2-5B, the sidewall may be a single continuous substantially cylindrical or annular wall, or may have several segments, and define an open proximal end and a distal, or far end as viewed in the Figures that is closed by a distal end wall 230. In the embodiment of FIGS. 6 and 7, the distal end wall 230 incorporates the first and second, longitudinally spaced and aligned exit orifices discharge ports or throats 210 and 212. These ports are defined so that they are offset from the power nozzle inlets, with port 210 being spaced radially outwardly of the nozzles 214 and 220, and port 212 being spaced radially outwardly of nozzles 216 and 218, with the ports being sized and located with respect to the nozzles and the interaction chamber 204 to discharge the fluid product distally in first and second spaced-apart oscillating sprays.

The power nozzles 214, 216, 218 and 220 are defined by the proximally extending or inwardly projecting, molded mesas 240, 242, 244 and 246 formed on the end wall, with mesas 246 and 240 cooperating to form power nozzle 214, mesas 240 and 242 forming power nozzle 216, mesas 242 and 244 forming power nozzle 218, and mesas 244 and 246 forming power nozzle 220.

Persons having skill in the art will appreciate that the invention illustrated FIGS. 2-7, and particularly in the preferred multi-outlet embodiment of FIGS. 6 and 7, as well as in the spray generation method of the present invention, provide a spray head nozzle structure member 200 including lumens to a shared interaction chamber 240, which, in cross section resembles chamber 140 as illustrated in FIGS. 5A and 5B, for dispensing or spraying a pumped or pressurized liquid product or fluid from a valve, pump or other actuator assembly drawing from a transportable container to generate a spray of fluid droplets. The actuator body has a distally projecting sealing post 138 (as illustrated in FIGS. 5A and 5B) with a post peripheral wall terminating at a distal or outer face (242 in FIG. 5A), where the actuator body cooperates with the insert to provide a fluid passage 246 communicating with the lumen. The cup-shaped multi-inlet orifice defining member such as that illustrated at 130 or 200 is mounted in the actuator body 136 and has a peripheral wall 159 or wall segments 160, 162 or 232, 234 extending proximally into a bore in the actuator body radially outwardly of the sealing post to form passageway 146. The conformal one-piece cup-shaped member 200 terminates distally in a transverse circular end wall having an inner face 244 opposing the sealing post's distal or outer face 242 to define the fluid channel 240. This fluid channel communicates with the shared interaction chamber (204) by way of multiple inlet power nozzles, and the interaction chamber terminates distally in at least one, and preferably multiple discharge orifices (e.g. 210, 212) defined in the distal or end wall.

Figure 8:
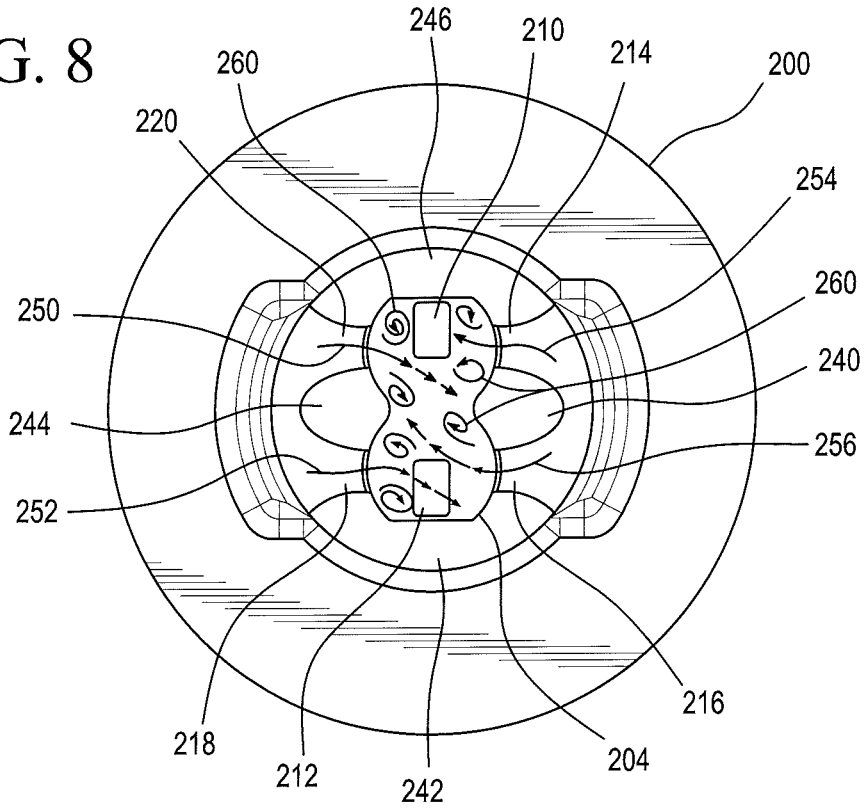
FIGS. 8-10 are plan-view diagrams of the conformal, one-piece cup-shaped member embodiment of FIGS. 6 and 7, illustrating fluid flow patterns in the fluidic geometry of that embodiment.
Figure 9:
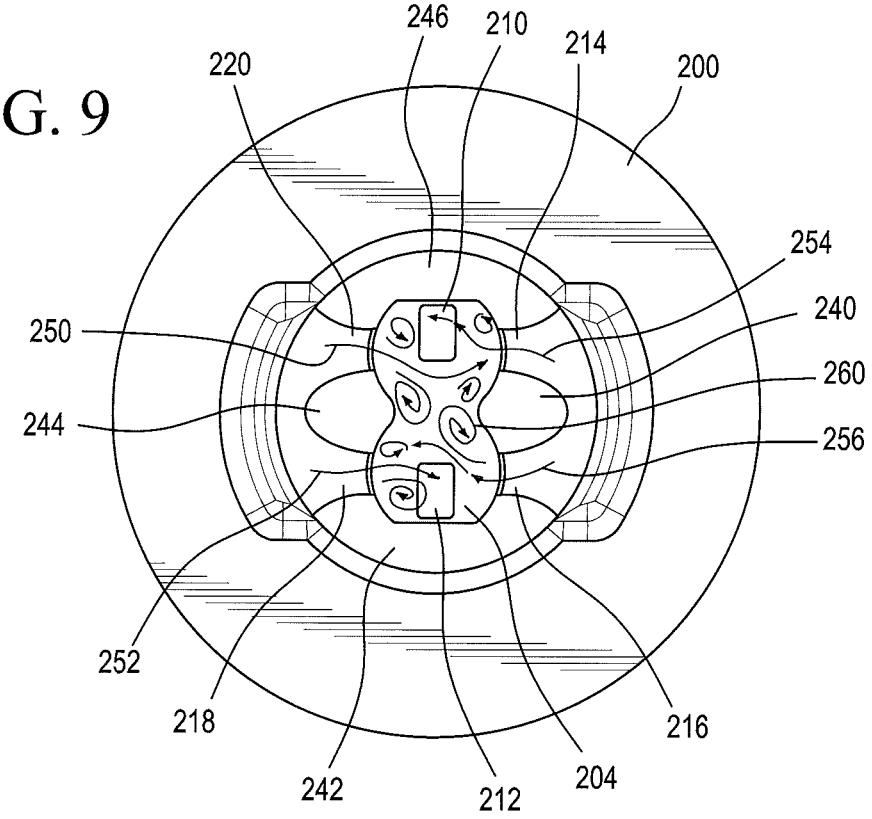
Figure 10:
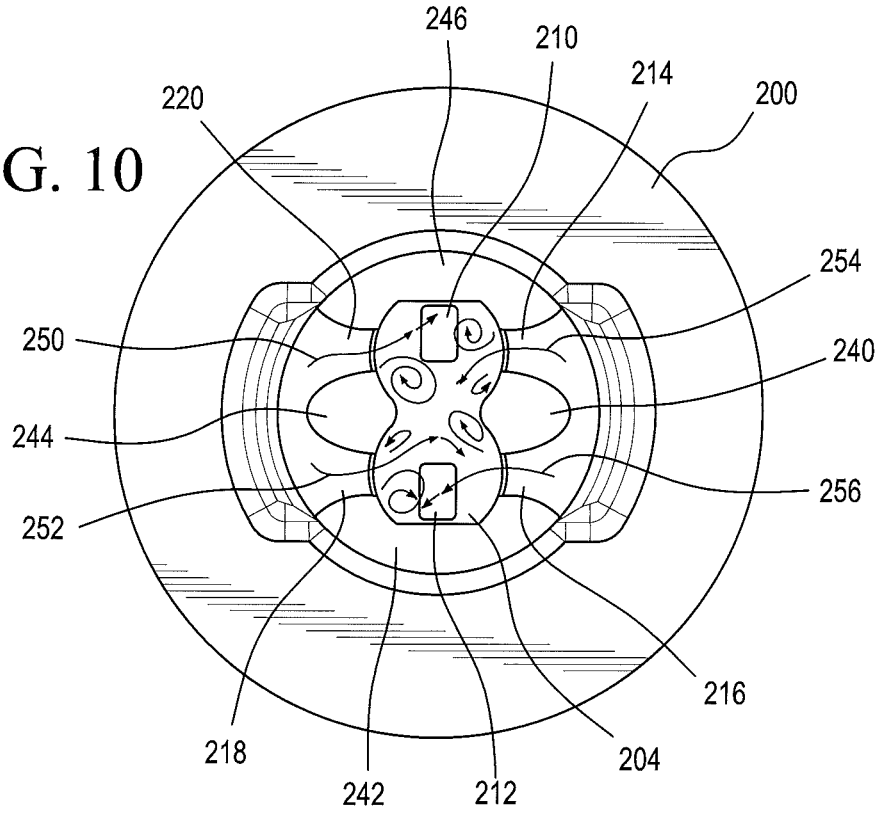

Referring now to the multi-outlet embodiment of FIGS. 6 and 7, and to corresponding FIGS. 8, 9 and 10 which illustrate the moving fluid vortices which enable operation of this embodiment, the conformal one-piece cup-shaped member 200 has a plurality of proximally projecting inlet defining wall segments, or mesas, with a first proximally projecting inlet defining wall segment 246 and a second proximally projecting inlet defining wall segment 244 being spaced apart to define a first tapered power nozzle lumen 220 (arrow "1" in FIG. 7) for accelerating pressurized fluid flowing through it and into the shared interaction chamber 204 to provide a first power nozzle fluid flow indicated at 250 in the fluid flow diagram of FIG. 8. The cup-shaped member 200 distal wall's inner face is also configured to define within the chamber a third proximally projecting inlet defining wall segment or mesa 242 spaced from the second proximally projecting inlet defining wall segment 244 and spaced apart to define a second power nozzle lumen 218 (arrow "2" in FIG. 7) therebetween, for accelerating pressurized fluid flowing through and into shared interaction chamber 204 to provide a second power nozzle fluid flow indicated at 252 in FIG. 8.

The cup-shaped member distal wall's inner face in the preferred multi-outlet embodiment of FIGS. 6-10 is preferably configured to define within the chamber a fourth proximally projecting inlet defining wall segment or mesa, 240 spaced from the first proximally projecting inlet defining wall segment 246 and spaced apart to define a third power nozzle lumen 214 (arrow "3" in FIG. 7) therebetween, for accelerating passing pressurized fluid flowing through it and into the shared interaction chamber 204 to provide a third power nozzle fluid flow 254 in FIG. 8. The fourth proximally projecting inlet defining wall segment or mesa 240 is also spaced from the third proximally projecting inlet defining wall segment 242 to define a fourth power nozzle lumen 216 (arrow "4" in FIG. 7) therebetween, for accelerating passing pressurized fluid flowing through and into the shared interaction chamber 204 to provide a fourth power nozzle fluid flow 256 (FIG. 8). The shared interaction chamber 204 is in fluid communication with the first, second, third and fourth power nozzles 214, 216, 218 and 220 defined in the cup-shaped member's distal wall, so that, when the nozzle assembly lumen receives pressurized fluid product, the first power nozzle fluid flow 250 is combined with the second power nozzle fluid flow 252, the third power nozzle fluid flow 254 and the fourth power nozzle fluid flow 256 to generate a plurality of unstable fluid vortices illustrated by the coiled arrows 260 in FIGS. 8, 9 and 19 within the shared interaction chamber. The unstable fluid vortices in the shared interaction chamber 204 collide with said first, second, third and fourth power nozzle fluid flows to generate an oscillating escaping fluid flow which exhausts from the fluid discharge orifices 210 and 212 as sprays of fluid droplets in a spray pattern determined by the shape and number of orifices, the characteristics of the fluid, and other factors as known in the fluidics art.

As illustrated in FIGS. 8-10, the fluid flows from the multiple power nozzles into the interaction chamber interact to generate and move the vortices 260 which destabilize the fluid flow pattern, pushing the incoming fluid jets from side to side within interaction chamber 204, creating oscillating flows. Thus, for example, the fluid 250 initially flows into the chamber 204 to create vortices, while its opposite incoming fluid jet 254 impinges on flow 250 and is deflected to the offset outlet 210. FIGS. 8, 9 and 10 illustrate the changes in the vortices during an oscillation cycle, so as the in rushing fluid jets continue to flow from power nozzles 214, 216, 218 and 220 into the shared interaction region, the vortices grow, as illustrated in FIG. 9, eventually reaching a size where they begin to push the incoming jet 250 back toward outlet 210, as illustrated in FIG. 10, and then the cycle repeats itself, eventually causing fluid flow 254 to again reach the outlet 210. The opposed inlet jets 252 and 256 interact in the same way, shifting first one jet and then the other to the corresponding offset outlet 212. Oscillation is preserved as each pair of jets interacts with the other pair in the common interaction area momentarily.

FIGS. 8-10 illustrate how the vortices for the incoming jets operate under similar conditions to those observed in a single spray fluidic cup. However, when the vortices grow on the exterior walls of the shared interaction region, the vortices push the jets (alternatively) into the middle, or shared, portion of the interaction region where they begin to interact with the adjacent pair of jets. At this point the jets begin to set up more internal vortices within that shared interaction region. FIG. 9 illustrates the flows at a moment where larger central vortices push interior jets away from each other and back into their paired partner jet. Then as the bi-stable oscillation continues, the vortices grow and decay periodically to reliably provide a bi-stable fluidic oscillator function. As the streams oscillate internally, they generate a flow of droplets having a selected size which escape in a periodic manner through the nozzle outlets or exit orifices 210, 212 distally and into the atmosphere.

The cup-shaped multi-inlet orifice defining wall segments, or mesas 240, 242, 244, 246 are preferably molded directly into the cup's interior surfaces to provide a unitary, integral, one-piece cup-shaped multi-inlet member 200 which is thus configured to be economically fitted onto a typical dispenser sealing post 138. The sealing post's distal or outer face 242 has a substantially flat and fluid impermeable outer surface in flat face sealing engagement with the cup-shaped member's inwardly projecting wall segments or mesas 240, 242, 244, 246 once assembled, to provide substantially fluid-tight enclosed lumens or fluid channels. The distally projecting sealing post's peripheral wall and the cup-shaped fluidic circuit's peripheral wall are spaced axially to define at least one fluid channel 232, 234 having a distally projecting lumen or passageway which is generally aligned with the distally projecting central axis of the sealing post 138. The resulting nozzle assembly is optionally configured for use with a hand operated pump in a trigger sprayer configuration (not shown) or is configured with propellant pressurized aerosol container with a valve actuator such as that illustrated in FIG. 1A. The nozzle assembly preferably has multiple discharge outlets in fluid communication with the shared interaction region and a geometry to allow for air entrainment into the shared interaction region and/or external oscillating spray streams to generate a foamed spray (with a selected "richness" of lather) of fluid product.

Figure 11:
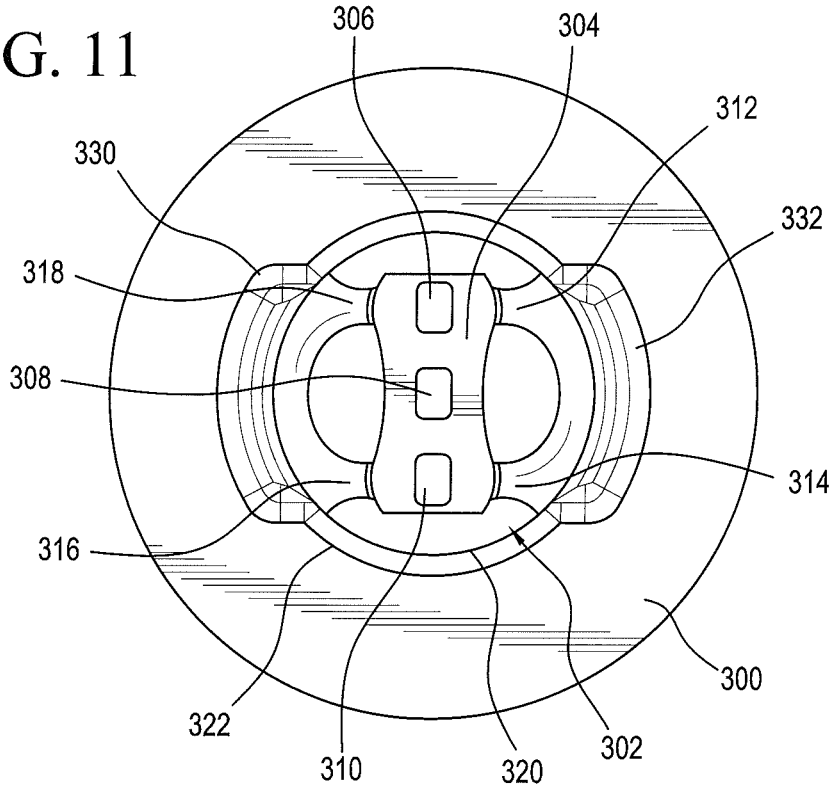
FIGS. 11 and 12 are plan-view diagrams of a third embodiment of the present invention, showing the interior surfaces and interior fluidic geometry of a multi-inlet, multi-outlet fluidic cup dispenser member, in accordance with the present invention.
Figure 12:
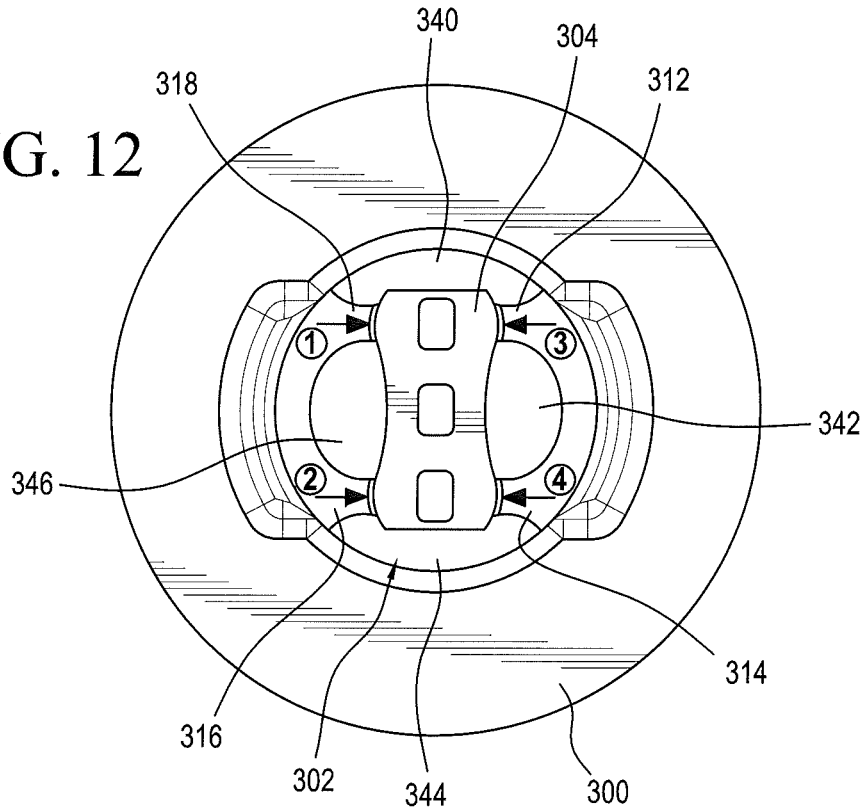

A three-discharge outlet embodiment of the conformal one-piece cup-shaped member present invention is illustrated in FIGS. 11 and 12, and provides a multi-inlet, multi-outlet cup-shaped nozzle member or insert 300. This embodiment is also preferably configured as a one-piece injection-molded plastic fluidic cup-shaped conformal nozzle member and does not require a multi-component insert and housing assembly. The fluidic oscillator's operative features, or geometry, 302 are preferably molded directly into the cup's interior surfaces and the cup is configured for easy installation to an actuator body 136, as in the above-described embodiments of the invention. The multi-inlet, single outlet fluidic cup embodiment 300 provides a fluidic circuit similar to that of FIGS. 6 and 7, and has a shared interaction region 304 as part of the fluidic circuit's oscillation inducing geometry 302 molded in-situ within a cup-shaped member so that once installed on an actuator's sealing post 138, a complete and effective fluidic oscillator nozzle is provided, as previously described.

The one-piece multi-inlet, multi-outlet fluidic cup oscillator 300 has first, second and third exit orifices or discharge ports 306, 308 and 310 in fluid communication with and at the distal end of the shared interaction region 304. Opposing tapered venturi-shaped power nozzles 312, 314, 316 and 318, and the shared interaction region 304 are in fluid communication with one another within the interior surface 320 of the molded interior surface of circular, planar or disc-shaped distal end-wall 322 of the conformal one-piece cup-shaped member 300. The interior surface includes grooves or troughs defining mesas between the four power nozzle inlets or channels of the oscillation-inducing geometry 302 which is located within the substantially cylindrical sidewall segments 330 and 332. As in prior embodiments, these sidewall segments define an open proximal end which engages a dispenser actuator to direct fluid through the fluidic circuit geometry 304 at the distal end of the insert 300 and out of the discharge ports. In the illustrated embodiment, the three exit orifices or ports 306, 308 and 310 are longitudinally aligned along the length of the interaction region 304, with the end ports 306 and 310 being outwardly offset from corresponding opposed nozzle pairs 312, 318 and 314, 316, respectively, and the central port 308 being centered between and again offset from the nozzle pairs, so that the fluid from the interaction region is sprayed distally in first, second and third spaced-apart oscillating sprays.

As illustrated in FIGS. 11 and 12, the inner distal face 320 of the cup-shaped insert is configured to define a fluidic chamber having a plurality of proximally projecting, nozzle inlet defining mesas, or wall segments 340, 342, 344 and 346, with a first proximally projecting inlet defining wall segment 340 and a second proximally projecting inlet defining wall segment 346 being spaced apart to define a first power nozzle lumen 318 (arrow "1" in FIG. 12) therebetween for accelerating passing pressurized fluid flowing into the shared interaction chamber 304 to provide a first power nozzle fluid flow. The cup-shaped member distal wall's inner face is also configured to define within the chamber a third proximally projecting inlet defining wall segment 344 spaced from the second proximally projecting inlet defining wall segment 346 and spaced apart to define a second power nozzle lumen 316 (arrow "2" in FIG. 12) therebetween, for accelerating passing pressurized fluid flowing into the shared interaction chamber 304 to provide a second power nozzle fluid flow.

The cup-shaped member distal wall's inner face further is preferably configured to define within the fluidic chamber the fourth proximally projecting inlet defining mesa or wall segment 342 spaced from the first proximally projecting inlet defining mesa or wall segment 340 and spaced apart to define the third power nozzle lumen 312 (arrow "3" in FIG. 12) therebetween, for accelerating passing pressurized fluid flowing into the shared interaction chamber 304 to provide a third power nozzle fluid flow. The fourth proximally projecting inlet defining mesa or wall segment 342 is also spaced from the third proximally projecting inlet defining mesa or wall segment 344 and spaced apart to define the fourth power nozzle lumen 314 (arrow "4" in FIG. 12) therebetween, for accelerating passing pressurized fluid flowing into the shared interaction chamber 304 to provide a fourth power nozzle fluid flow.

The shared interaction chamber thus is in fluid communication with the power nozzles defined in the cup-shaped member's distal wall, so that, when pressurized with fluid product, the first power nozzle fluid flow is combined with the second power nozzle fluid flow, the third power nozzle fluid flow and the fourth power nozzle fluid flow to generate a plurality of unstable fluid vortices within said shared interaction chamber, in the manner illustrated in FIGS. 8-10. As described with respect to those Figures, the unstable fluid vortices in the shared interaction chamber collide with the incoming power nozzle fluid flows to generate an oscillating escaping fluid flow which exhausts from the offset discharge orifices 306, 308 and 310 to spray fluid droplets in a selected spray pattern.

Figure 13:
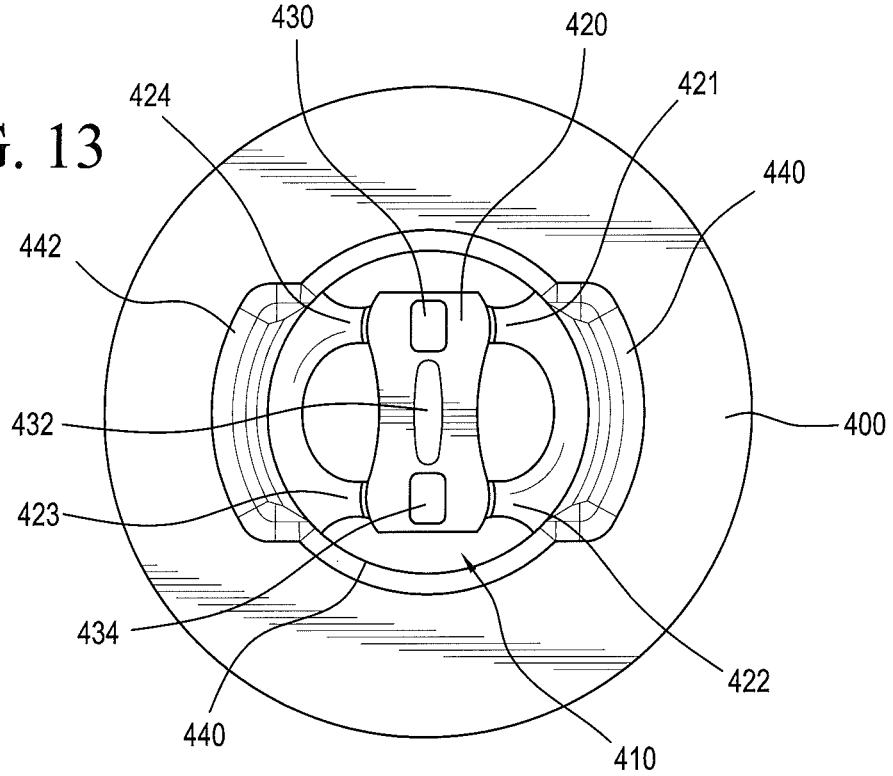
FIGS. 13 and 14 are plan-view diagrams of a fourth embodiment of the present invention, showing the interior surfaces and interior fluidic geometry of a multi-inlet, multi-outlet fluidic cup dispenser member, in accordance with the present invention.
Figure 14:
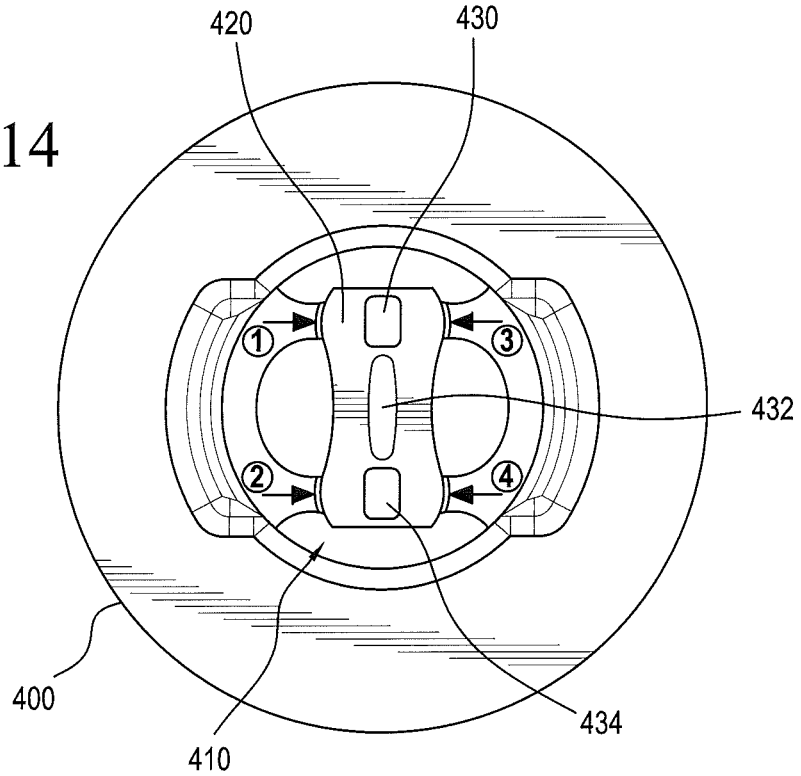

Another three-discharge outlet embodiment, illustrated at 400 in FIGS. 13 and 14, provides a multi-inlet, multi-outlet cup-shaped nozzle member which is also preferably configured as a one-piece injection-molded plastic fluidic cup-shaped conformal nozzle or insert member that does not require a multi-component insert and housing assembly. The fluidic oscillator's operative features or geometry 410 are preferably molded directly into the cup's interior surfaces and the cup is configured for easy installation to an actuator body, as in prior embodiments of the present invention. The multi-inlet, multi-outlet fluidic cup embodiment 400 provides the same novel fluidic circuit as the prior embodiments, and thus includes a shared interaction region 420 as part of the fluidic circuit's oscillation inducing geometry 410 molded in-situ within the cup-shaped member so that once installed on an actuator's sealing post, a complete and effective fluidic oscillator nozzle is provided.

In this embodiment, the one-piece multi-inlet, multi-outlet fluidic cup oscillator insert 400 has first, second, third and fourth opposing tapered venturi-shaped power nozzles 421, 422, 423 and 424 leading to the shared interaction region 420. First, second and third exit orifices or discharge ports 430, 432 and 434 extend through the distal end wall, are in fluid communication between the exterior of the insert and the shared interaction region 420, and are spaced longitudinally along the region 420. The exit orifices or discharge ports are shaped differently than those of the embodiment of FIGS. 11 and 12 in order to produce a different oscillating spray pattern, and it will be understood that the number, shape, spacing and location of the discharge ports with respect to the interaction region may be selected to provide a desired outlet spray pattern.

In this case, the outermost ports 430 and 434 are substantially aligned with corresponding opposed nozzles 421, 424 and 422, 423, respectively; that is, the centers of the ports are aligned with the axes of their corresponding nozzles, while the central port 432 is elongated, extending between the outermost ports and offset from all of the inlet power nozzles. The molded interior surface of circular, planar or disc-shaped end wall 440 includes grooves or troughs defining shaped mesas spaced to provide the four inlet power nozzles 421-424 of the channel oscillation-inducing geometry 410 and is located within the substantially cylindrical sidewall segments 442 and 444, which define an open proximal end for receiving fluid from a dispenser, in the manner previously described.

The plurality of proximally projecting inlet defining mesas, or wall segments are shaped and spaced apart to define the power nozzle lumens 424, 423, 421 and 422 (arrows "1", "2", "3" and "4", respectively, in FIG. 14) therebetween, for accelerating passing pressurized fluid flowing through them and into the shared interaction chamber 420 to provide power nozzle fluid flows, as previously described with respect to FIGS. 11 and 12. As described, the shared interaction chamber is in fluid communication with power nozzles defined in the cup-shaped member's distal wall so that, when pressurized with fluid product, the first power nozzle fluid flow is combined with the second power nozzle fluid flow, the third power nozzle fluid flow and the fourth power nozzle fluid flow to generate a plurality of unstable fluid vortices within the shared interaction chamber. The unstable fluid vortices in the shared interaction chamber collide with the first, second, third and fourth power nozzle fluid flows to generate an oscillating escaping fluid flow which exhausts from the discharge orifices 430, 432 and 434 sprays of fluid droplets in a selected spray pattern, in the manner described with respect to FIGS. 8-10.

Figure 15:
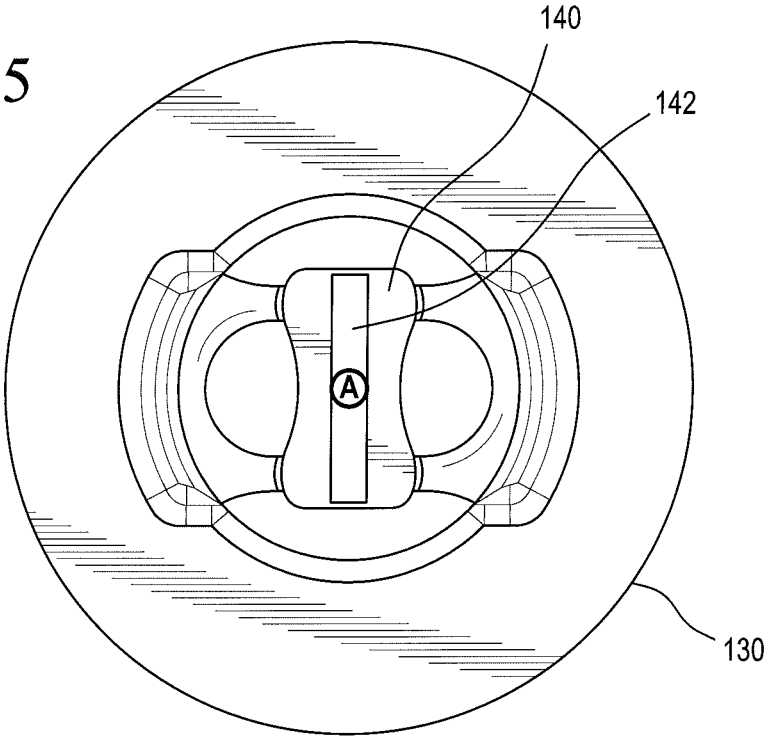
FIGS. 15, 16 and 17 are plan-view diagrams of alternative embodiments of the conformal, one-piece cup-shaped member of the present invention, configured for use in generating a foaming spray, in accordance with the present invention.
Figure 16:
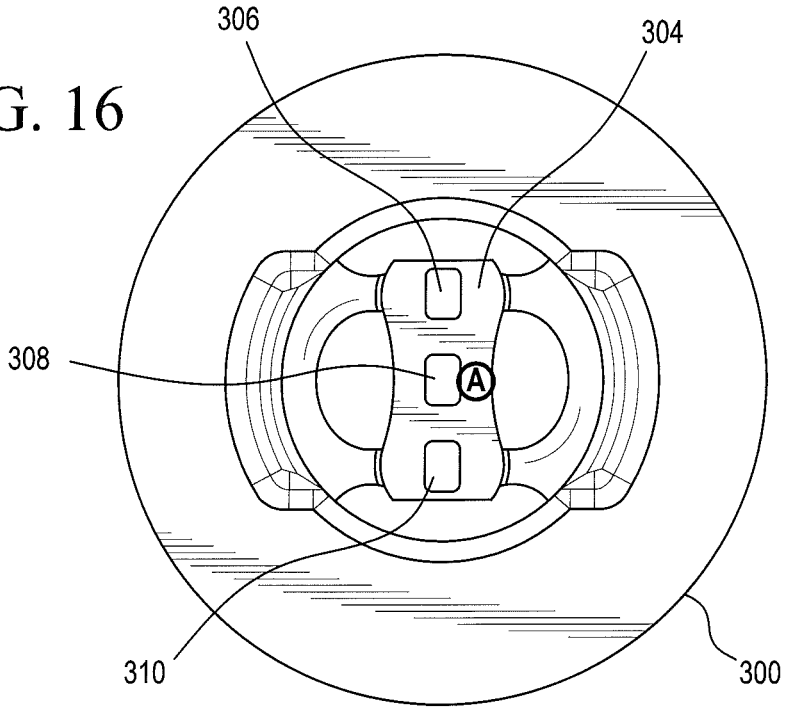
Figure 17:
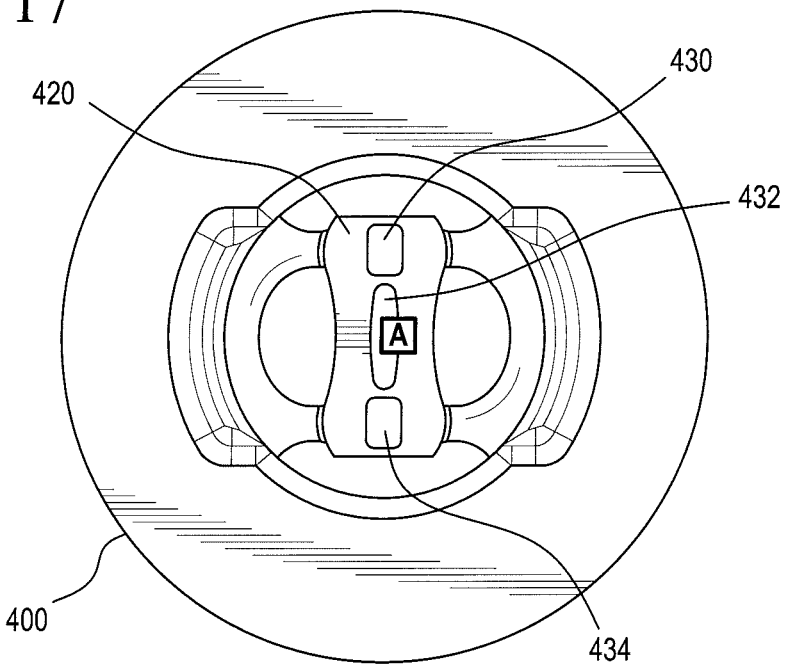

A modification of the foregoing embodiments for generating a foamed spray with entrained air is illustrated in FIG. 15 (which corresponds to the embodiment FIGS. 3, 4, 5A and 5B, and in the embodiment of FIG. 15, the nozzle member 130 is configured to generate a clinging foam discharge at aperture location "A". Referring now to FIG. 15, the outlet port 142 can be positioned in the cup end wall defining the shared interaction region and have a specific geometry selected to provide air entrainment into the interaction region 140 and the exiting oscillating spray streams from outlet port 142 generates a foamed spray (not shown). Referring next to FIGS. 16 and 17 (which correspond to Figs. FIGS. 11, 12 and FIGS. 13, 14, respectively), in these embodiments, the nozzles are also configured to generate a clinging foam discharge at aperture or location "A". Referring now to FIGS. 16 and 17, one of the multiple outlet ports or discharge orifices can be positioned in the cup end wall defining the shared interaction region with an internal fluidic geometry configured to provide air entrainment into the interaction region (e.g., 304, 420) and the exiting oscillating spray streams from outlet ports (e.g., 306, 308, 310; or 430, 432, 434, respectively), to generate a foamed spray.

The ambient air can be entrained at location "A" (as shown in FIGS. 16 and 17), and this can be done either through a dedicated discharge aperture, or outlet port, or within an area of a larger outlet port where a local low pressure region within the interaction chamber draws air in, as shown in FIG. 15. The ambient air entrainment opening can be dimensioned and configured to control the spray pattern and to control the amount of air entrained into the oscillating spray streams for specific fluid products. Persons of skill in the art will appreciate that entraining air into a flowing fluid can lower the effective viscosity of that fluid. Therefore, adding the air entrainment feature as illustrated in FIGS. 15-17 will enable the nozzle and delivery system (aerosol, BOV or trigger sprayer) to spray more viscous fluids (e.g., in the range of 1-80 cps) while maintaining desired flow rates and distribution. The exact shape of aperture or region "A" is not that critical, but the lumen opening area is important. A larger aperture "A" produces higher foaming and a lower aperture cross sectional area produces less foam. Aperture A can be circular, rectangular, oval etc. In the exemplary embodiments shown in FIGS. 15, 16 and 17, the large slot shaped aperture 142 generates the highest foam followed by the embodiments illustrated in FIG. 17 and then 16.

For prototype embodiments of the nozzles illustrated in FIGS. 15, 16 and 17, the foaming mentioned is less than a lather. Superficial foaming is achieved by exposing the moving vortices of fluid within a vacuum-like low pressure region within the fluidic's interaction region to outside or ambient air which is drawn proximally into the interaction region at a discharge orifice lumen portion which is closest to that low pressure or vacuum-like region. Drawing ambient air proximally into the fluid vortices allows the ambient air sucked into the interaction region to mix with the outgoing oscillating spray stream/jet. The size and shape of the aperture "A" dictates the both the amount and the distribution of the foaming. A larger aperture "A" generates more foaming, and the shapes of aperture "A" also convey the shape of the foam within the spray distribution. The foaming of the spray is likely to be useful for a marker but also helps facilitate "cling", wherein the sprayed fluid is prevented from running down a vertical surface on a distal target object sprayed by a user. Users typically characterize having the fluid product run (instead of sticking to the target surface where sprayed) as an undesirable outcome or nuisance. This problem is typical of traditional swirl nozzles (e.g., as illustrated in FIGS. 1A-1*c*, but is NOT observed when products are sprayed from the fluidic nozzles of the present invention (as illustrated in FIGS. 15-17). Liquid product characteristics affect foaming performance. Liquids with surfactants (added) will produce foam. Foam generation performance is related to surface tension of the liquid (lower numbers produce foam), where water is considered to have high surface tension. Examples of liquid products suitable for spraying with a foaming nozzle such as those shown in FIGS. 15-17 are soap and cleaning solutions, where adding and mixing air will generate a desirable foam.

Applicants have discovered that the fluidic geometry for the shared interaction region features described and illustrated in these embodiments do not necessarily abide by the prior understanding of the relationships for fluidic nozzle features, and the related geometric ratios, when optimized, do not appear as expected. For example, in the embodiment illustrated in FIGS. 6-10, the two discharge ports or spray outlets are illustrated as being offset outwardly from the centerlines of opposed power nozzles, while in the embodiments of FIGS. 11, 12 and 13, 14, where three outlet ports are provided, it is the center port that is offset. In the case of a traditional single outlet discharge port (with only one pair of power nozzle inlets) this offset is preferably avoided; however, applicants have discovered that the offset outlet ports work very well for a multiple inlet, multiple outlet, shared interaction region fluidic oscillator cup nozzle, for the offset outlet ports provide additional spray optimization opportunities. Benefits of offset outlet ports are equally apparent for any number of inlet nozzles.

Figure 18:
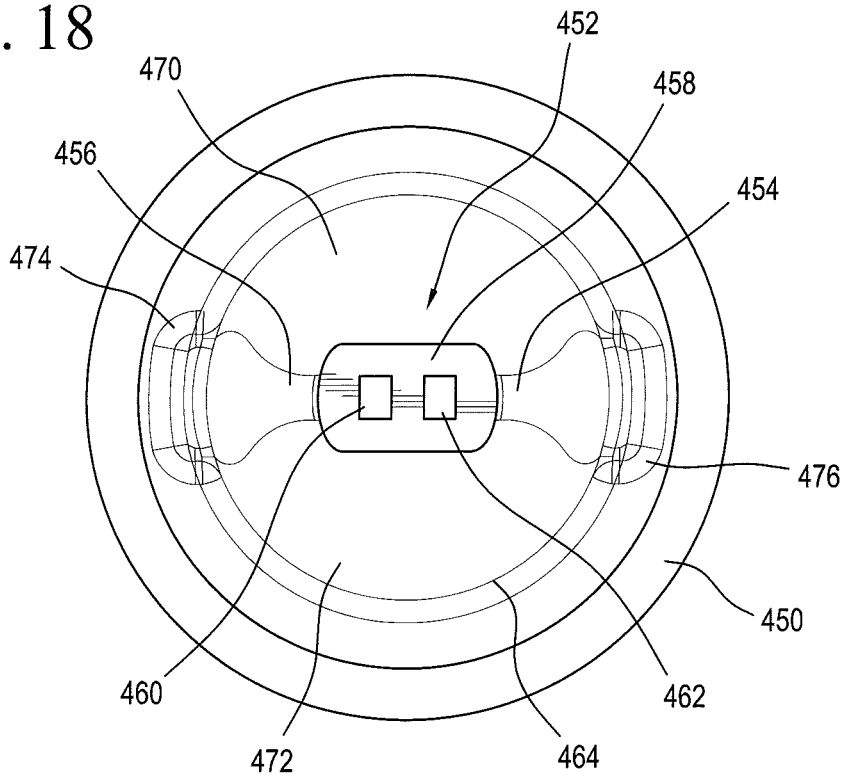
FIG. 18 is a plan-view diagram of a fifth embodiment of the present invention, showing the interior surfaces and interior fluidic geometry of a multi-inlet, multi-outlet fluidic cup dispenser member utilizing a single pair of inlet power nozzles, in accordance with the present invention.

Turning now to FIG. 18, another embodiment of the invention is illustrated, wherein a multi-inlet, multi-outlet cup-shaped nozzle member, or insert 450 incorporates fluidic geometry 452 having two opposed tapered venturi-shaped power inlet nozzles 454 and 456 supplying fluid under pressure to a common interaction chamber 458 which includes two discharge outlet ports 460 and 462. This embodiment is also preferably configured as a one-piece injection-molded plastic fluidic cup-shaped conformal nozzle member which does not require a multi-component insert and housing assembly. The fluidic oscillator operative features, or geometry, 458 are preferably molded directly into the cup's interior surfaces, as in prior embodiments, and the cup is configured for easy installation to an actuator body over a sealing post 138, as described above. The multi-inlet, multi-outlet fluidic cup embodiment 450 provides a novel fluidic circuit in which the shared interaction region 458 is part of the fluidic circuit's oscillation inducing geometry 452 and is molded in-situ within the cup-shaped member so that once installed on an actuator sealing post 138, a complete and effective fluidic oscillator nozzle is provided.

The first and second discharge ports 460 and 462 for the one-piece multi-inlet, multi-outlet fluidic cup oscillator 450 are aligned along the common axis of the fluid inlet power nozzles 454, 456 and are in fluid communication with and proximate the shared interaction region 458. The first and second opposing tapered venturi-shaped inlets or power nozzles 454 and 456 and the shared interaction region 458 are in fluid communication with one another within the interior surface of a distal end-wall 464 of the insert. The molded interior surface of circular, planar or disc-shaped end wall 464 includes grooves or troughs defining mesas 470 and 472 which are spaced apart and shaped to produce the two inlet power nozzles of the oscillation-inducing geometry 452 and is located within substantially cylindrical sidewall segments 474 and 476. The sidewall segments define an open proximal end for receiving fluid to be sprayed. The closed distal end of the insert includes the laterally spaced and aligned distal discharge ports or throats 460 and 464 defined therethrough. As in prior embodiments, these discharge ports are sized, shaped and positioned to spray fluid product distally in first and second spaced-apart oscillating sprays.

The cup-shaped member distal wall's inner face is configured to define a plurality of proximally projecting inlet defining mesas, or wall segments with the first proximally projecting inlet defining wall segment 470 and the second proximally projecting inlet defining wall segment 472 being spaced apart to define the first power nozzle lumen 456 therebetween, for accelerating passing pressurized fluid flowing through and into the shared interaction chamber 458 to provide a first power nozzle fluid flow (from the left, as seen in FIG. 18). The first and second proximally projecting inlet defining wall segments 470 and 472 also define the second power nozzle lumen 454 therebetween, for accelerating passing pressurized fluid flowing through and into the shared interaction chamber 458 to provide a second power nozzle fluid flow. The shared interaction chamber is in fluid communication with the first and second power nozzles defined in the cup-shaped member's distal wall, so that, when pressurized with fluid product, the first power nozzle fluid flow is combined with the second power nozzle fluid flow, they generate a plurality of unstable fluid vortices within the shared interaction chamber 458. The unstable fluid vortices in the shared interaction chamber collide with the first and second power nozzle fluid flows to generate oscillating escaping fluid flows which exhaust from the discharge orifices 460, 462 as distal sprays of fluid droplets in a selected spray pattern.

Figure 19:
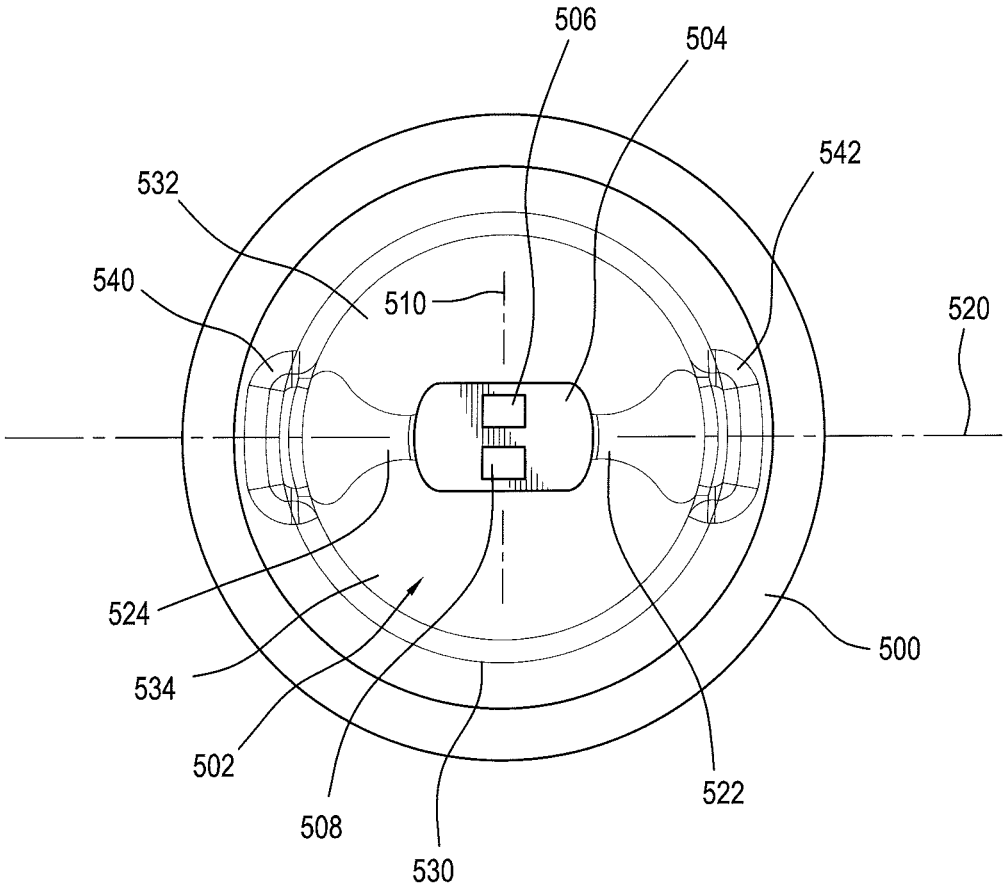
FIG. 19 is a plan-view diagram of a sixth embodiment of the present invention, showing the interior surfaces and interior fluidic geometry of a multi-inlet, multi-outlet fluidic cup dispenser member utilizing a single pair of inlet power nozzles, in accordance with the present invention.

Another two discharge outlet, two power nozzle embodiment is illustrated in FIG. 19 and provides a multi-inlet, multi-outlet cup-shaped nozzle member or insert 500 which is also preferably configured as a one-piece injection-molded plastic fluidic cup-shaped conformal nozzle member which does not require a multi-component insert and housing assembly. The insert incorporates fluidic oscillator operative features or geometry 502 which are preferably molded directly into the cup's interior surfaces, and the cup is configured for easy installation to an actuator body. The multi-inlet, multi-outlet fluidic cup embodiment 500 illustrated in FIG. 19 provides a novel fluidic circuit which has a shared interaction region 504 as part of the fluidic circuit oscillation inducing geometry 502 molded in-situ within the cup-shaped nozzle member, or insert, so that once installed on an actuator's sealing post, a complete and effective fluidic oscillator nozzle is provided. The one-piece multi-inlet, multi-outlet fluidic cup oscillator 500 has first and second spaced-apart discharge ports 506 and 508 which are aligned along a lateral axis 510 which is transverse to interaction region 504 and to a longitudinal axis 520 of a pair of opposed power nozzle fluid inlets 522 and 524. The outlet ports are spaced on either side of axis 520, and thus are offset from the power nozzles, and are in fluid communication with and proximate the shared interaction region 504.

The first and second opposing tapered venturi-shaped power nozzles 522 and 524 and the shared interaction region 504 are in fluid communication with one another within the interior surface of distal end-wall 530 of the insert 500. The molded interior surface of circular, planar or disc-shaped end wall 530 includes grooves or troughs defining mesas 532 and 534 which are shaped to form the two power nozzle inlets in the channel oscillation-inducing geometry 502 and is located within substantially cylindrical sidewall segments 540 and 542, which define an open proximal end for receiving fluid to be sprayed. The closed distal end wall of the insert 500 includes the laterally spaced and aligned discharge ports 506,508 defined therethrough so that discharge ports are sized, shaped and located to spray fluid product distally in first and second spaced-apart oscillating sprays.

As described with respect to prior embodiments, the inner wall of the cup-shaped member, or insert 500 is configured to define the plurality of proximally projecting inlet defining mesas, or wall segments 532 and 534 spaced apart to define the first power nozzle lumen 524 therebetween, for accelerating passing pressurized fluid flowing through and into the shared interaction chamber 504 to provide a first power nozzle fluid flow (from the left, as seen in FIG. 19). The first and second proximally projecting inlet defining wall segments 532 and 534 also define the second power nozzle lumen 522 therebetween, for accelerating passing pressurized fluid flowing through and into the shared interaction chamber 504 to provide a second power nozzle fluid flow (from the right, as viewed in FIG. 19). The shared interaction chamber 504 is in fluid communication with the first and second power nozzles as defined in the cup-shaped member's distal wall, so that, when pressurized with fluid product, the first power nozzle fluid flow is combined with the second power nozzle fluid flow to generate a plurality of unstable fluid vortices within the shared interaction chamber 504. The unstable fluid vortices in the shared interaction chamber collide with the first and second power nozzle fluid flows to generate oscillating escaping fluid flows which exhaust from the discharge orifices 506, 508 as distal sprays of fluid droplets in a selected spray pattern.

Broadly speaking, the embodiments of FIGS. 18 and 19 illustrate that a multi-inlet, multi-outlet spray nozzle insert in accordance with the invention and having multiple outlets (e.g., 2-4) can be used in conjunction with a single pair of power nozzle inlets. The number, location and shape of the outlets dictate the outlet spray coverage pattern, droplet size and spray distribution. The geometry of each discharge orifice or outlet is chosen to avoid external interaction of the oscillating spray streams to preserve droplet size developed by fluidic nozzle oscillation. The fluidic cup member 500 illustrated in FIG. 19 has operating principals which are in some ways analogous to applicant's multi-spray design illustrated in FIGS. 1E-1G and described in U.S. Pat. No. 8,172,162, which is incorporated herein by reference.

Having described preferred embodiments of a new and improved nozzle assembly and method, it is believed that other modifications, variations and changes will be suggested to those skilled in the art in view of the teachings set forth herein. It is therefore to be understood that all such variations, modifications and changes are believed to fall within the scope of the claims which also comprise part of the description of the present invention.

What is claimed is:

1. A nozzle assembly or spray head including a lumen or duct for dispensing or spraying a pumped or pressurized liquid product or fluid from a valve, pump or actuator assembly drawing from a transportable container to generate a spray of fluid droplets or generate a foamed spray, comprising;

(a) an actuator body having a distally projecting sealing post having a post peripheral wall terminating at a distal or outer face, said actuator body including a fluid passage communicating with said lumen;

(b) a cup-shaped multi-inlet orifice defining member mounted in said actuator body having a peripheral wall extending proximally into a bore in said actuator body radially outwardly of said sealing post and having a distal radial wall comprising an inner face opposing said sealing post's distal or outer face to define a fluid channel including a shared interaction chamber between said body's sealing post and said cup-shaped member's peripheral wall and distal wall, said fluid channel terminating distally in a first discharge orifice defined in said distal wall;

(c) said shared interaction chamber being in fluid communication with said actuator body's fluid passage to define a plurality of inlet lumens so said pressurized fluid may enter said fluid channel's shared interaction chamber;

(d) wherein said cup-shaped member distal wall's inner face is configured to define within said chamber a plurality of proximally projecting inlet defining wall segments or mesas with a first proximally projecting inlet defining mesa and a second proximally projecting inlet defining mesa spaced apart to define a first power nozzle lumen therebetween, for accelerating passing pressurized fluid flowing through and into said shared interaction chamber to provide a first power nozzle fluid flow;

(e) wherein said cup-shaped member distal wall's inner face is also configured to define within said chamber a third proximally projecting inlet defining mesa spaced from said second proximally projecting inlet defining mesa and spaced apart to define a second power nozzle lumen therebetween, for accelerating passing pressurized fluid flowing through and into said shared interaction chamber to provide a second power nozzle fluid flow;

(f) wherein said cup-shaped member distal wall's inner face is also configured to define within said chamber a fourth proximally projecting inlet defining mesa spaced from said first proximally projecting inlet defining mesa and spaced apart to define a third power nozzle lumen therebetween, for accelerating passing pressurized fluid flowing through and into said shared interaction chamber to provide a third power nozzle fluid flow;

(g) wherein said fourth proximally projecting inlet defining mesa is also spaced from said third proximally projecting inlet defining mesa and spaced apart to define a fourth power nozzle lumen therebetween, for accelerating passing pressurized fluid flowing through and into said shared interaction chamber to provide a fourth power nozzle fluid flow;

(h) wherein each power nozzle lumen includes a flow axis, wherein the flow axis of said first power nozzle lumen is substantially parallel to the flow axis of said second power nozzle lumen and the flow axis of said third power nozzle lumen is substantially parallel to the flow axis of said fourth power nozzle lumen;

(i) wherein said shared interaction chamber is in fluid communication with said first, second, third and fourth power nozzles defined in said cup-shaped member's distal wall, and said first power nozzle fluid flow is combined with said second power nozzle fluid flow, said third power nozzle fluid flow and said fourth power nozzle fluid flow to generate a plurality of unstable fluid vortices within said shared interaction chamber; and (j) wherein the unstable fluid vortices in said shared interaction chamber collide with said first, second, third and fourth power nozzle fluid flows to generate an oscillating escaping fluid flow which exhausts from said first exit orifice or discharge orifice as either (a) a spray of fluid droplets of a selected droplet size range (e.g., Dv50 between 20 pm and 180 pm) in a selected spray pattern, or (b) a foamed spray.

2. The nozzle assembly of claim 1, wherein said cup-shaped multi-inlet orifice defining member wall segments are molded directly into said cup's interior surfaces and the cup-shaped multi-inlet orifice defining member is thus configured to be economically fitted onto the sealing post.

3. The nozzle assembly of claim 2, wherein said sealing post's distal or outer face has a substantially flat and fluid impermeable outer surface in flat face sealing engagement with the cup-shaped member's inwardly projecting wall segments or mesas.

4. The nozzle assembly of claim 3, wherein said distally projecting sealing post's peripheral wall and said cup-shaped fluidic circuit's peripheral wall are spaced axially to define said fluid channel as first and second distally projecting lumens which are generally aligned with the central axis of the sealing post.

5. The nozzle assembly of claim 1, wherein said nozzle assembly is configured with a hand operated pump in a trigger sprayer configuration.

6. The nozzle assembly of claim 1, wherein said nozzle assembly is configured with propellant pressurized aerosol container with a valve actuator.

7. The nozzle assembly of claim 1, wherein said cup's distal end wall further comprises a second exit orifice or discharge outlet in fluid communication with the shared interaction region and having a geometry to allow for air entrainment into the shared interaction region and/or external oscillating spray streams to generate a foamed spray of fluid product.

8. The nozzle assembly of claim 1, wherein said cup-shaped multi-inlet orifice defining member is configured as a conformal, unitary, one-piece fluidic circuit configured for easy and economical incorporation into a trigger spray nozzle assembly or aerosol spray head actuator body including distally projecting sealing post and a lumen for dispensing or spraying a pressurized liquid product or fluid from a transportable container to generate an exhaust flow in the form of an oscillating spray of fluid droplets, comprising;

(a) a cup-shaped fluidic circuit member having a peripheral wall extending proximally and having a distal radial wall comprising an inner face with features defined therein and an open proximal end configured to receive an actuator's sealing post;

(b) said cup-shaped member's peripheral wall and distal radial wall having inner surfaces comprising a fluid channel including a chamber when said cup-shaped member is fitted to body's sealing post;

(c) said chamber being configured to define a fluidic circuit oscillator inlet in fluid communication with said shared interaction chamber defining an interaction region so when said cup-shaped member is fitted to body's sealing post and pressurized fluid is introduced via said actuator body, the pressurized fluid may enter said fluid channel's chamber and interaction region and generate at least one oscillating flow vortex within said fluid channel's interaction region;

(d) wherein said cup shaped member's distal wall includes said first discharge orifice in fluid communication with said chamber's interaction region.

9. The conformal, unitary, one-piece fluidic circuit of claim 8, wherein said chamber is configured so that when said cup-shaped member is fitted to the body's sealing post and pressurized fluid is introduced via said actuator body, said chamber's fluidic oscillator inlet is in fluid communication with a first power nozzle pair comprising said first power nozzle and second power nozzle, wherein said first power nozzle is configured to accelerate the movement of passing pressurized fluid flowing through said first nozzle to form a first jet of fluid flowing into said chamber's interaction region, and said second power nozzle is configured to accelerate the movement of passing pressurized fluid flowing through said second nozzle to form a second jet of fluid flowing into said chamber's interaction region, and wherein said first and second jets impinge upon one another at a selected inter-jet impingement angle and generate oscillating flow vortices within said fluid channel's interaction region.

10. The conformal, unitary, one-piece fluidic circuit of claim 9, wherein said chamber is configured so that when said cup-shaped member is fitted to the body's sealing post and pressurized fluid is introduced via said actuator body, said chamber's interaction region is in fluid communication with said discharge orifice defined in said fluidic circuit's distal wall, and said oscillating flow vortices exhaust from said discharge orifice as an oscillating spray of substantially uniform fluid droplets in a selected spray pattern having a selected spray width and a selected spray thickness.

11. The conformal, unitary, one-piece fluidic circuit of claim 10, wherein said first and second power nozzles comprise venturi-shaped or tapered channels or grooves in said distal wall's inner face.

12. The conformal, unitary, one-piece fluidic circuit of claim 11, wherein said first and second power nozzles terminate in a substantially rectangular or box-shaped interaction region defined in said distal wall's inner face.

13. The conformal, unitary, one-piece fluidic circuit of claim 12, wherein said first and second power nozzles terminate in a substantially hourglass-shaped interaction region defined in said distal wall's inner face.

14. The conformal, unitary, one-piece fluidic circuit of claim 10, wherein said selected inter-jet impingement angle is 180 degrees and said chamber is configured so that when said cup-shaped member is fitted to the body's sealing post and pressurized fluid is introduced via said actuator body, said oscillating flow vortices are generated within said fluid channel's interaction region by opposing jets.

15. The conformal, unitary, one-piece fluidic circuit of claim 10, wherein said nozzle assembly is configured with a hand operated pump in a trigger sprayer configuration.

16. The conformal, unitary, one-piece fluidic circuit of claim 10, wherein said nozzle assembly is configured with propellant pressurized aerosol container with a valve actuator.

17. A conformal one-piece cup-shaped nozzle oscillating spray generating member comprising:

a substantially cylindrical sidewall terminating distally in a substantially circular closed end wall with an interior surface within which is defined a fluidic circuit geometry defining a shared interaction chamber in fluid communication with at least a first discharge orifice aimed to distally project an oscillating spray or a foam discharge; and wherein said shared interaction chamber is in fluid communication with and is configured to generate moving vortices from a first power nozzle lumen, a second power nozzle lumen, a third power nozzle lumen and a fourth power nozzle lumen;

wherein each power nozzle lumen includes a flow axis;

wherein the flow axis of said first power nozzle lumen is substantially parallel to the flow axis of said second power nozzle lumen and the flow axis of said third power nozzle lumen is substantially parallel to the flow axis of said fourth power nozzle lumen; and wherein each of said power nozzle lumens are aimed at an opposing power nozzle lumen along opposing power nozzle flow axes to provide an interactive pair of power nozzle flows for generating moving vortices within the shared interaction chamber.

18. The conformal one-piece cup-shaped nozzle oscillating spray generating member of claim 17, wherein said shared interaction chamber is also in fluid communication with at a second discharge orifice aimed to distally project an oscillating spray or a foam discharge; and wherein said shared interaction chamber is in fluid communication with and is configured to generate moving vortices from said first power nozzle lumen, said second power nozzle lumen, said third power nozzle lumen and said fourth power nozzle lumen to generate either (a) first and second separate, unrecombined oscillating sprays or (b) a foam discharge.

19. The conformal one-piece cup-shaped nozzle oscillating spray generating member of claim 17, wherein a first interactive pair of power nozzles is configured with opposing power nozzle flow axes aimed at said first discharge orifice.

20. The conformal one-piece nozzle oscillating spray generating member of claim 17, wherein said first and second power nozzles comprise at least one of a venturi-shaped, tapered channels, and grooves in said interior surface.

21. The conformal one-piece nozzle oscillating spray generating member of claim 17, wherein said first and second power nozzles terminate in a substantially rectangular interaction region defined in said interior surface.

22. The conformal one-piece nozzle oscillating spray generating member of claim 17, wherein said first and second power nozzles terminate in a substantially hourglass-shaped interaction region defined in said interior surface.

23. The conformal one-piece nozzle oscillating spray generating member of claim 17, wherein said shared interaction chamber define a plurality of inlet lumens so a pressurized fluid may enter said shared interaction chamber;

wherein said interior surface is configured to define within said shared interaction a plurality of proximally projecting inlet defining wall segments or mesas with a first proximally projecting inlet defining mesa and a second proximally projecting inlet defining mesa spaced apart to define said first power nozzle lumen therebetween, for accelerating passing pressurized fluid flowing through and into said shared interaction chamber to provide a first power nozzle fluid flow;

wherein said interior surface is also configured to define within said shared interaction chamber a third proximally projecting inlet defining mesa spaced from said second proximally projecting inlet defining mesa and spaced apart to define said second power nozzle lumen therebetween, for accelerating passing pressurized fluid flowing through and into said shared interaction chamber to provide a second power nozzle fluid flow;

wherein said interior surface is also configured to define within said shared interaction chamber a fourth proximally projecting inlet defining mesa spaced from said first proximally projecting inlet defining mesa and spaced apart to define said third power nozzle lumen therebetween, for accelerating passing pressurized fluid flowing through and into said shared interaction chamber to provide a third power nozzle fluid flow;

wherein said fourth proximally projecting inlet defining mesa is also spaced from said third proximally projecting inlet defining mesa and spaced apart to define said fourth power nozzle lumen therebetween, for accelerating passing pressurized fluid flowing through and into said shared interaction chamber to provide a fourth power nozzle fluid flow; and wherein said shared interaction chamber is in fluid communication with said first, second, third and fourth power nozzles defined in said interior surface, and said first power nozzle fluid flow is combined with said second power nozzle fluid flow, said third power nozzle fluid flow and said fourth power nozzle fluid flow to generate a plurality of unstable fluid vortices within said shared interaction chamber.

24. The conformal one-piece nozzle oscillating spray generating member of claim 23, wherein the unstable fluid vortices in said shared interaction chamber collide with said first, second, third and fourth power nozzle fluid flows to generate an oscillating escaping fluid flow which exhausts from said first exit orifice or discharge orifice as either (a) a spray of fluid droplets in a selected spray pattern having a selected droplet size that ranges between 20 μm Dv50 and 180 μm Dv50, or (b) a foamed spray.

25. The conformal one-piece nozzle oscillating spray generating member of claim 17, wherein said first power nozzle lumen and said second power nozzle lumen are aligned along a first side of the shared interaction chamber and said third power nozzle lumen and said fourth power nozzle lumen are aligned along a second side of the shared interaction chamber, and said second side is opposite said first side.

* * * * *